US009591923B2

(12) United States Patent
Zeidner et al.

(10) Patent No.: US 9,591,923 B2
(45) Date of Patent: Mar. 14, 2017

(54) DIVIDER FOR SHELFING AND METHOD AND SYSTEM FOR DIVIDING A SHELF

(71) Applicants: Daniel Zeidner, Quogue, NY (US); Jason T. Eltman, Fayetteville, NY (US)

(72) Inventors: Daniel Zeidner, Quogue, NY (US); Jason T. Eltman, Fayetteville, NY (US)

( * ) Notice: Subject to any disclaimer, the term of this patent is extended or adjusted under 35 U.S.C. 154(b) by 0 days.

(21) Appl. No.: 14/948,451

(22) Filed: Nov. 23, 2015

(65) Prior Publication Data

US 2016/0073776 A1 Mar. 17, 2016

Related U.S. Application Data

(63) Continuation-in-part of application No. 29/476,597, filed on Dec. 16, 2013, now Pat. No. Des. 745,796, and a continuation-in-part of application No. 14/156,642, filed on Jan. 16, 2014, now abandoned.

(51) Int. Cl.

| | |
|---|---|
| ***A47B 57/58*** | (2006.01) |
| ***A47F 5/00*** | (2006.01) |
| ***A47B 65/00*** | (2006.01) |

(52) U.S. Cl.

CPC ..... *A47B 57/588* (2013.01); *A47B 57/583* (2013.01); *A47B 65/15* (2014.12); *A47F 5/005* (2013.01)

(58) Field of Classification Search

CPC .... A47F 5/005; A47F 3/02; A47F 5/00; A47F 7/144; A47F 5/132; A47F 5/10; A47B 57/58; A47B 57/583; A47B 57/585; A47B 57/586; A47B 57/588; A47B 65/00; A47B 65/10; A47B 65/15; A47B 88/20; A47B 2088/202; B65D 25/04; B65D 25/06; B65D 2501/2421; B65D 2501/24216

USPC ..... 211/184, 175; 108/61, 60; 248/909, 239, 248/220.31, 220.41; 403/359.1, 359.6, 403/383; 220/529, 532, 533, 550, 545; 422/300; 206/370

IPC ..... B65D 25/04,25/06, 2501/2421, 2501/24216

See application file for complete search history.

(56) References Cited

U.S. PATENT DOCUMENTS 3,501,020 A * 3/1970 Krikorian ..... A47F 5/005 211/184
3,698,568 A * 10/1972 Armstrong ..... A47F 5/005 211/184
3,858,529 A * 1/1975 Salladay ..... A47B 49/004 108/103
3,888,348 A * 6/1975 Frey ..... A47G 23/0208 206/427
3,944,176 A * 3/1976 Danko ..... H04Q 1/142 174/72 A
3,954,184 A * 5/1976 Mendenhall ..... A47F 5/005 211/184
4,488,653 A * 12/1984 Belokin ..... A47F 5/005 108/61
4,889,253 A * 12/1989 Schmulian ..... A45C 13/02 220/551
5,148,927 A * 9/1992 Gebka ..... A47F 5/005 108/60

(Continued)

*Primary Examiner* — Daniel J Troy
*Assistant Examiner* — Hiwot Tefera

(57) ABSTRACT

A divider adapted to be mounted on a shelf for segregating items stored or displayed on the shelf, and also a method and system of dividing a shelf for the storage and the display of items.

26 Claims, 33 Drawing Sheets

(56) References Cited

U.S. PATENT DOCUMENTS 5,437,380 A * 8/1995 Peay ..... A47F 5/0056 108/61
5,555,990 A * 9/1996 Bechstein ..... A47F 3/0486 211/184
5,599,512 A * 2/1997 Latulippe ..... A61L 2/26 206/438
5,678,794 A * 10/1997 Kump ..... A47F 5/0869 211/59.1
5,803,276 A * 9/1998 Vogler ..... A47F 5/005 108/60
6,585,119 B2 * 7/2003 Palder ..... A47F 7/28 211/163
6,644,606 B1 * 11/2003 Seidel ..... G09F 7/18 248/220.41
6,685,037 B1 * 2/2004 Zadak ..... A47B 57/58 108/61
7,036,779 B2 * 5/2006 Kawaguchi ..... F16B 5/0642 174/135
7,066,563 B2 * 6/2006 Berger ..... A47B 88/20 312/205
7,618,103 B2 * 11/2009 Kim ..... A47B 46/00 108/138
7,703,866 B2 * 4/2010 Benz ..... F25D 25/02 211/184
8,556,092 B2 * 10/2013 Valiulis ..... A47F 5/005 108/61
2005/0082449 A1 * 4/2005 Kawaguchi ..... F16B 5/0642 248/220.31
2005/0150847 A1 * 7/2005 Hawkinson ..... A47F 5/005 211/59.2
2006/0011794 A1 * 1/2006 Zadak ..... A47F 5/0884 248/220.31
2010/0252519 A1 * 10/2010 Hanners ..... A47F 5/005 211/184
2013/0020270 A1 * 1/2013 Valiulis ..... A47F 5/005 211/59.2

* cited by examiner

DIVIDER FOR SHELFING AND METHOD AND SYSTEM FOR DIVIDING A SHELF

CROSS-REFERENCE TO RELATED APPLICATIONS

This application for a utility patent is a continuation-in-part of the application for a design patent by the same inventors filed Dec. 16, 2013, entitled "REUSABLE SHELF DIVIDER", Ser. No. 29/476,597, and is a continuation-in-part of the application for utility patent by the same inventors filed Jan. 16, 2014, entitled "DIVIDER FOR SHELVING AND METHOD AND SYSTEM FOR DIVIDING A SHELF", Ser. No. 14/156,642. The entire content of both applications is incorporated herein by reference, and the applicant claims the benefit of priority to both applications.

FIELD OF THE INVENTION

The present application relates to a divider that can be used with shelving, especially shelving often used in connection with the retail display of various products, and also relates to a method and system for dividing a shelf for the storage and the display of items.

BACKGROUND OF THE INVENTION

Many products are stored or displayed on shelves. Typically, for example, a retail store will display its various wares on a shelf or tiers of shelves for viewing by a potential customer. Typically also, the retail store displays several identical items on such shelves so that if a customer grasps one of the items, at least one more of the items will be available for viewing and potential purchase by another customer.

In order to enhance the most effective use of such shelves, it is preferred to maintain identical wares directly one behind the other and different wares situated in immediate, adjacent proximity. Sometimes store personnel or store customers place or replace the various items in a somewhat disheveled manner that deviates from the most effective presentation of the items such that identical items are not lined up directly one behind the other and such that different items are not immediately adjacent thereto.

Dividers consisting of thin strips or fences, usually formed of metal or plastic, have been mounted on the shelves in order to restrict the placement and presentation of identical items in a column a directly one-behind-the-other relationship and so that different items may be placed immediately adjacent thereto, also in a column in a directly one-behind-the-other relationship. One of the difficulties with such prior art divider systems is that the relative width between dividers that exactly accommodates a particular item varies among the different items shared or displayed along the shelf. For example, a shelf that stores and displays both spray paint cans and bottles of motor oil requires different spacing between the dividers, since the width of a spray paint can is usually different from the width a bottle of motor oil. Similarly, different sized bags of potato chips will require different spacing between the dividers. To further complicate matters, a store often wishes to rearrange the display of products on shelves, and the dividers should be removable and reusable in order to accommodate any such rearrangement.

Typically, store shelves are formed of metal and possess a pre-selected array of perforations or apertures therethrough, which are designed to accommodate various types of dividers, clip-on display hangers, sign holders, and other shelving accessories. Also typically, such apertures have been fashioned with either a circular profile or a square or diamond-shaped profile possessing common dimensions.

The present invention was developed to satisfy the need for an inexpensively manufactured divider that may accommodate different shelving aperture arrays and designs and that is removable and reusable, although each of these desirable features is not necessarily required as part of the invention recited in the following claims.

SUMMARY OF THE INVENTION

The present invention relates to a divider adapted to be mounted on a shelf for segregating items stored or displayed on the shelf, and also relates to a method and system of dividing a shelf for the storage and the display of items.

BRIEF DESCRIPTION OF THE DRAWINGS

The invention will be described with reference to the accompanying drawings, wherein.

DESCRIPTION OF A PREFERRED EMBODIMENT

Figure 1:
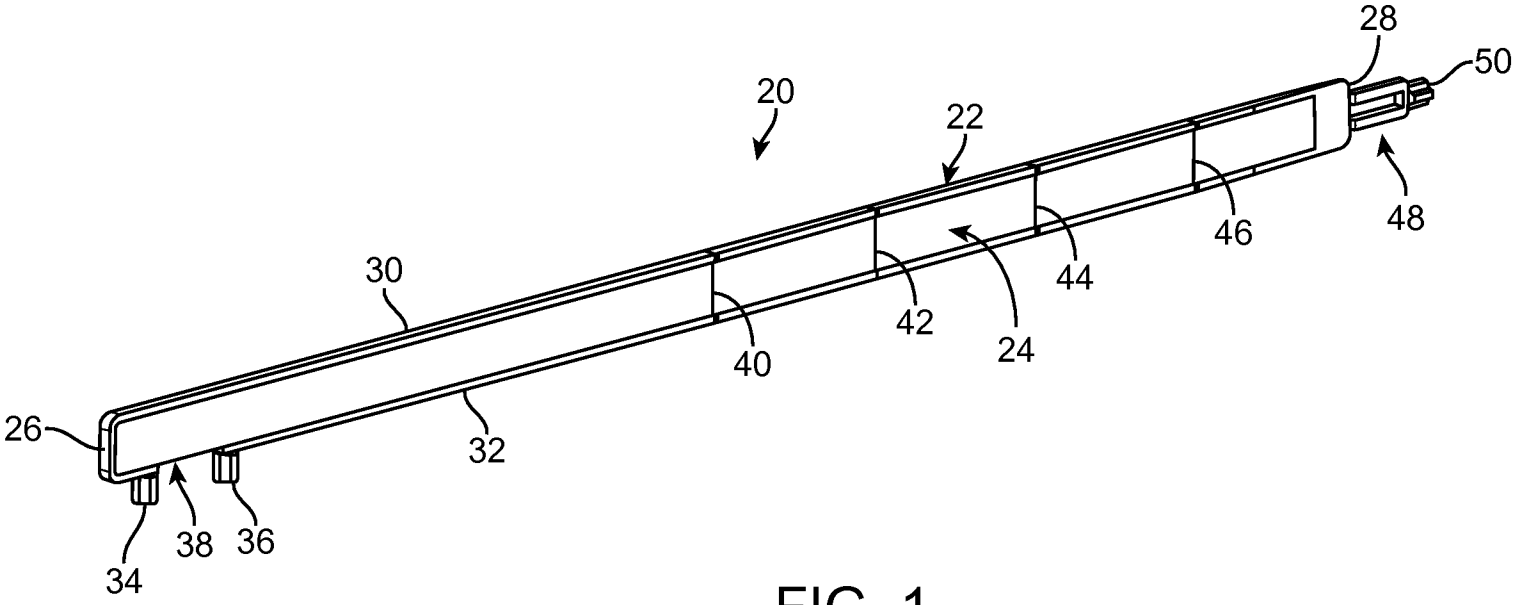
FIG. 1 is a perspective view of one embodiment of a divider according to the present invention.

The present invention will be described with reference to the accompanying drawings when like reference numerals refer to the same item. It should be appreciated that the following description is intended to be exemplary only, and the scope of the invention envisions other variations and modifications of these particular exemplary embodiments.

Figure 9:
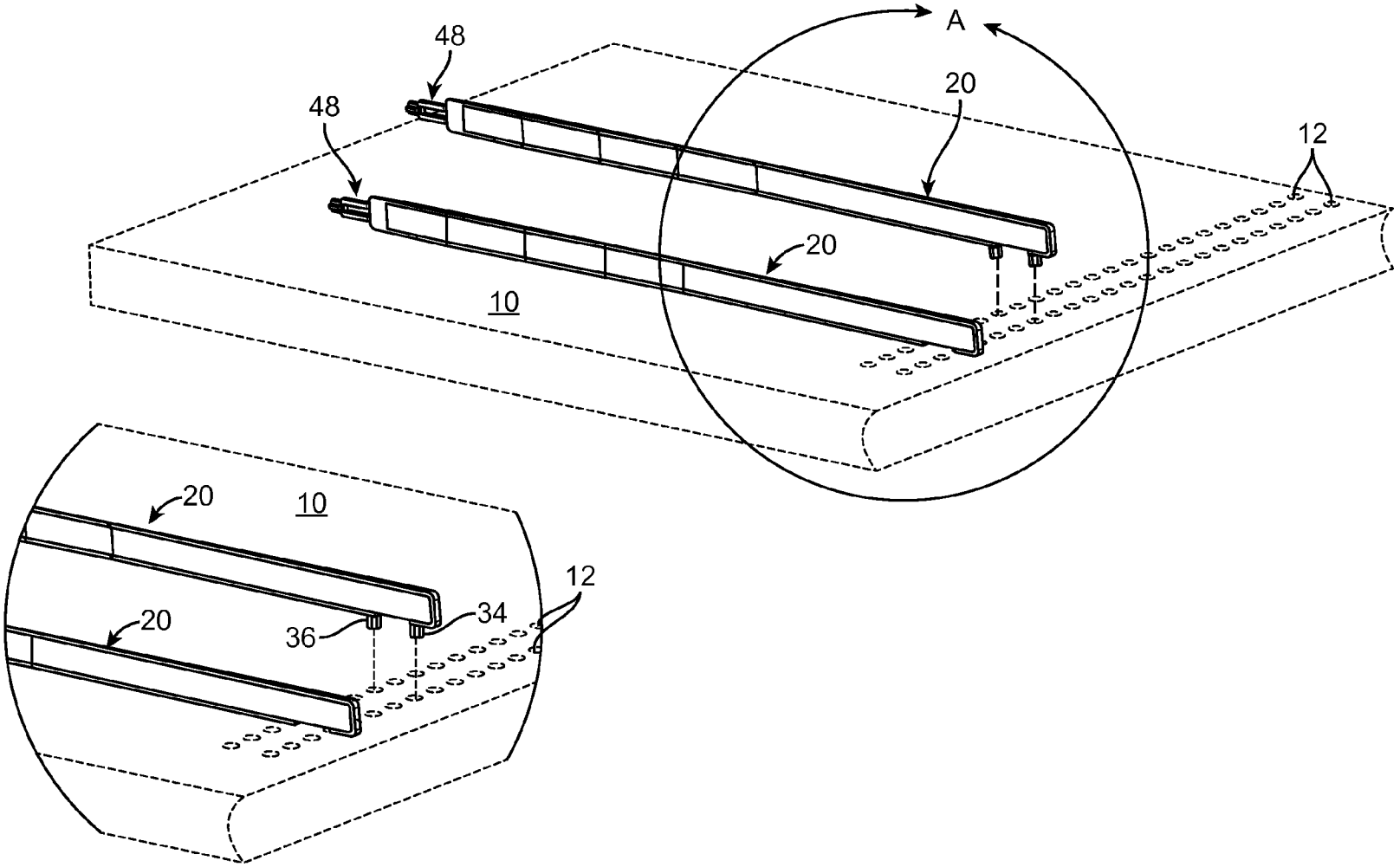
FIG. 9 shows two perspective views of two of the dividers shown in FIG. 1 as installed and as being installed on a section of prior art shelf, with one of the perspective views showing a detailed view of a portion circled as A in the other perspective view.
Figure 10:
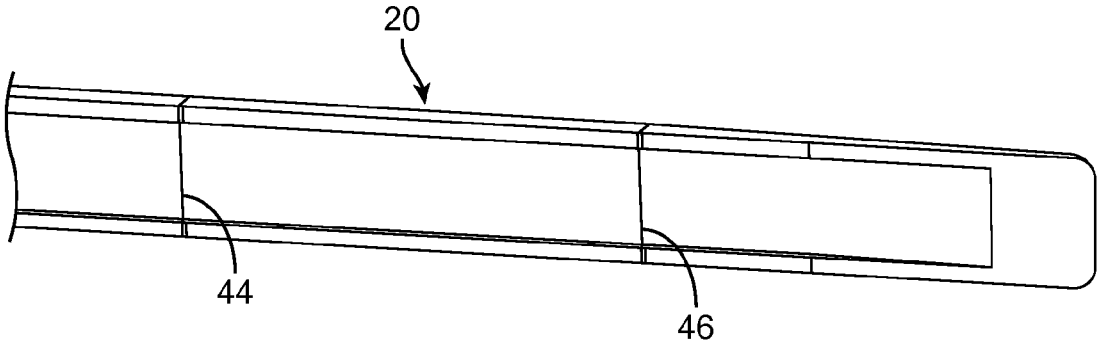
FIG. 10 is a perspective view of the rear portion of the divider shown in FIG. 1 with the back pin detached.
Figure 17:
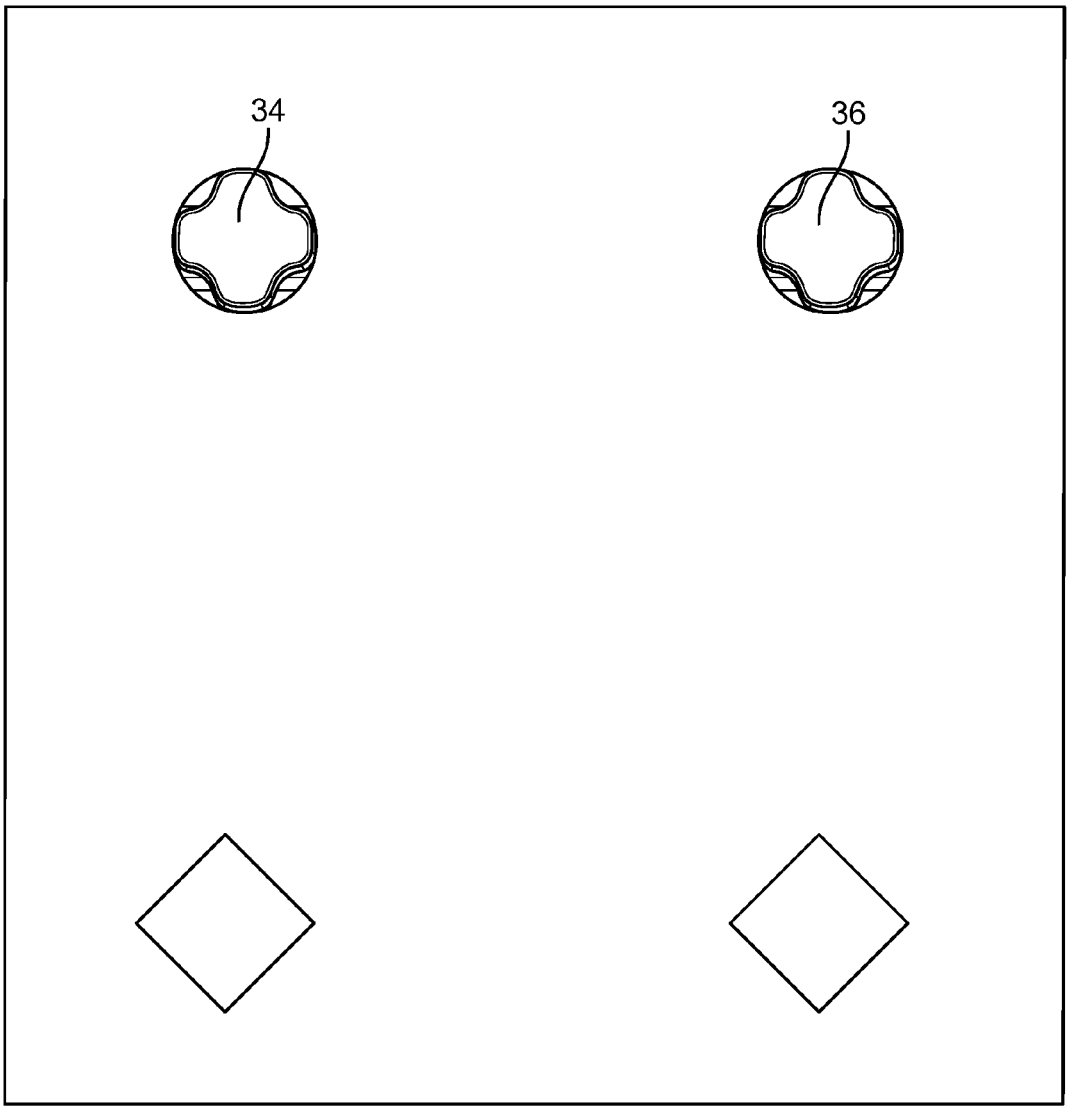
FIG. 17 is an illustration of the lugs shown in FIG. 12 disposed within circular holes in a prior art shelf.
Figure 18:
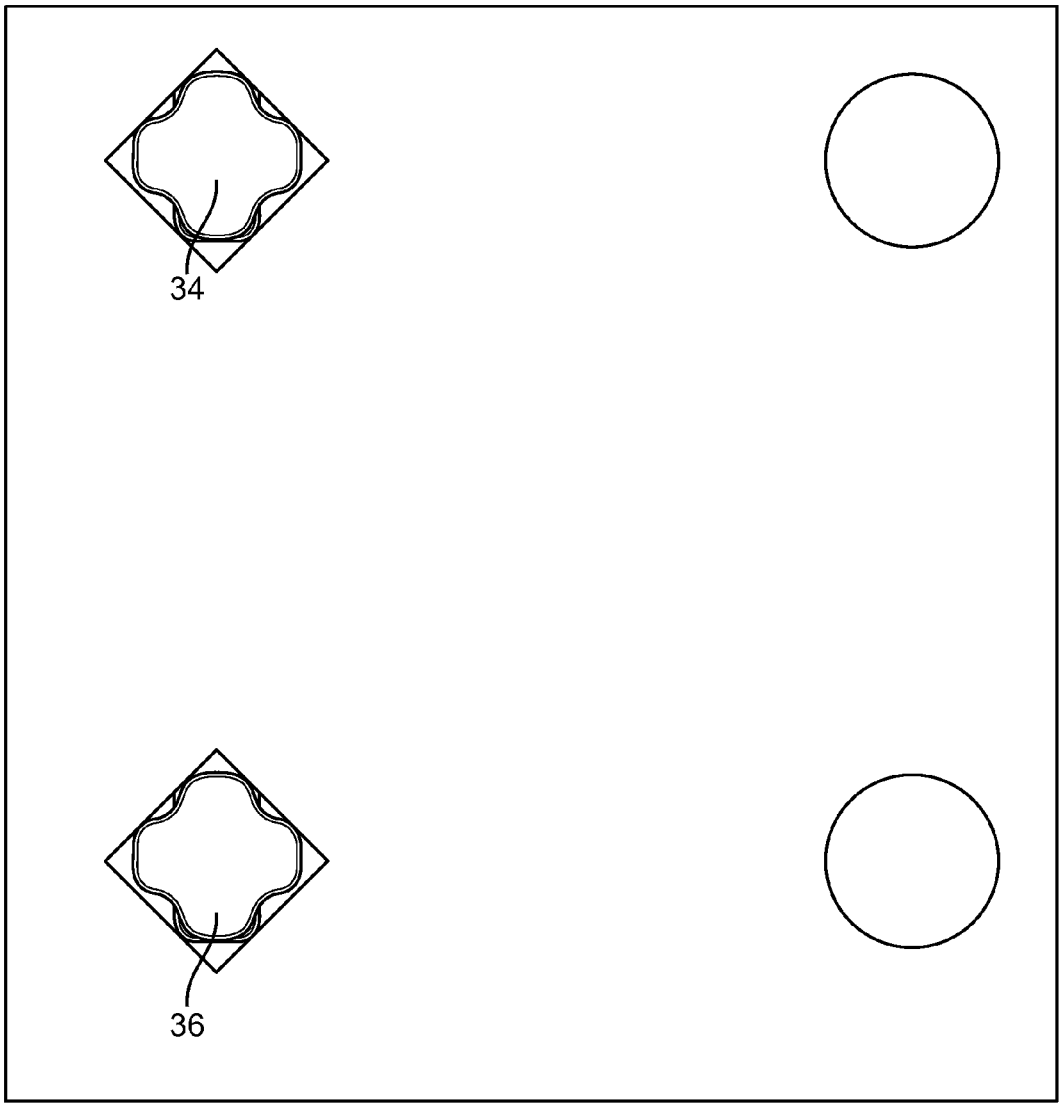
FIG. 18 is an illustration of the lugs shown in FIG. 12 disposed within square or diamond-shaped holes in a prior art shelf.
Figure 36:
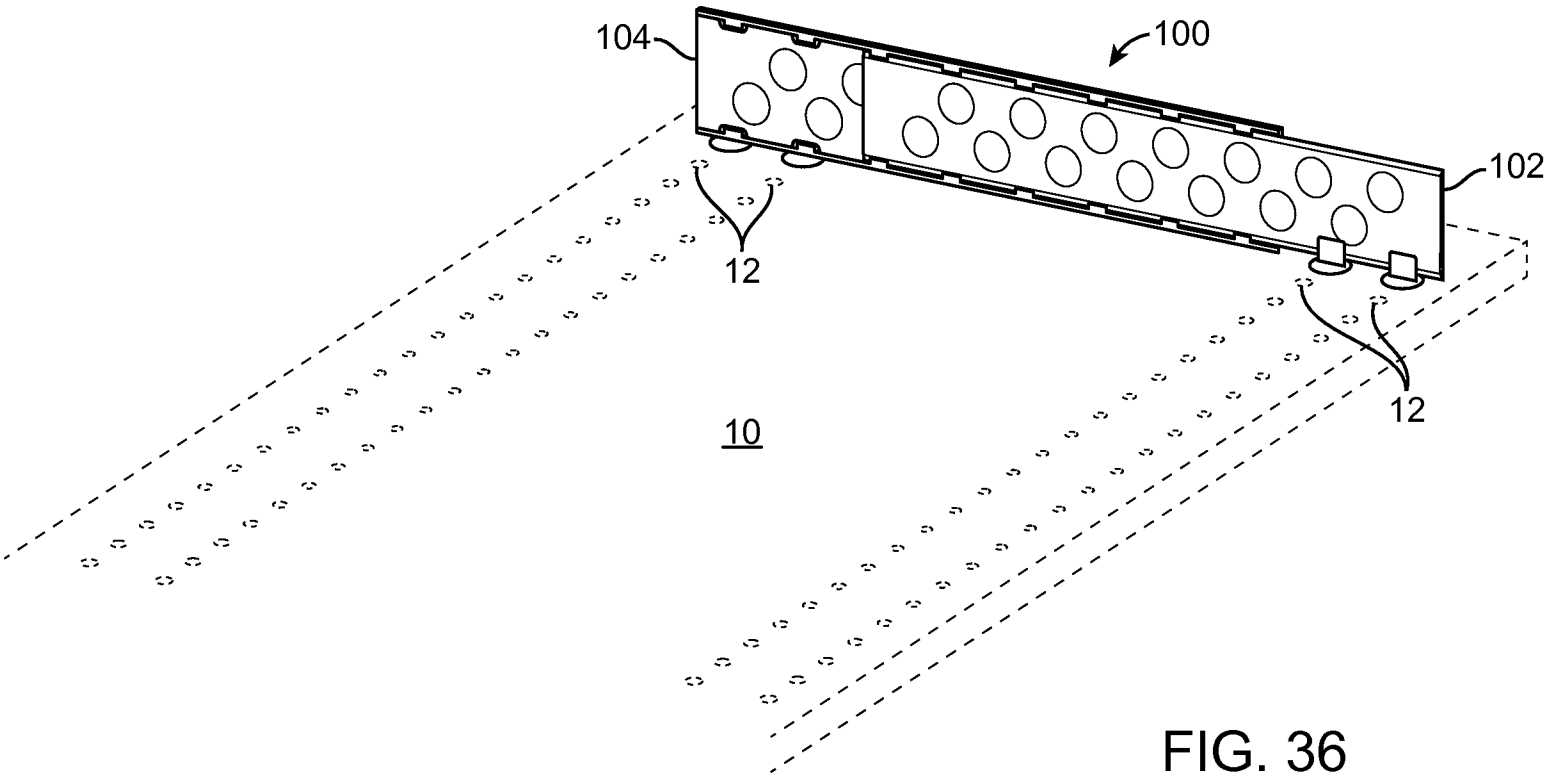
FIG. 36 is an enlarged perspective view of the divider in an extended condition shown in FIG. 35 as installed on a shelf.

There shown in FIGS. 9 and 36 a shelf 10 possessing an array of perforations or apertures 12 disposed therein. For simplicity purposes, only two rows of apertures 12 have been shown in FIG. 9, but it should be appreciated that a top surface of the shelf 10 may possess a wide variety of arrays of such apertures 12. A commonly available shelf known in the shelving industry as a Gondola shelf possesses two rows of apertures extending along the front of the shelf, and also an identical set of rows of apertures extending along the back of the shelf, as shown in FIG. 36. Although, the apertures 12 shown in FIGS. 9 and 36 each possess a circular profile and are shown in a regularly spaced array of rows and columns, it should be appreciated that the invention contemplates use with square or diamond-shaped aperture profiles such as are shown in FIGS. 17 and 18 as well as potentially other aperture profile configurations and array configurations. Further, although the apertures 12 may extend completely through the shelf 10, the invention contemplates that the apertures 12 may extend only partially into the shelf 10, such that the apertures 12 are essentially depressions in the surface of the shelf 10. Normally, the same particular circular, square or diamond-shaped, or other profile of the apertures 12 identically exists throughout the entire extent of the array, whether the aperture 12 is in the nature of a depression in the shelf 10 or extends completely through the shelf 10. The invention also contemplates that the aperture profiles may vary within an array.

Figure 2A:
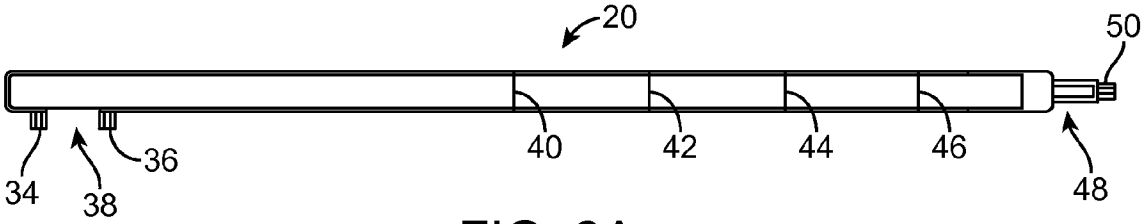
FIG. 2A is right side plan view of the divider shown in FIG. 1.
Figure 2B:
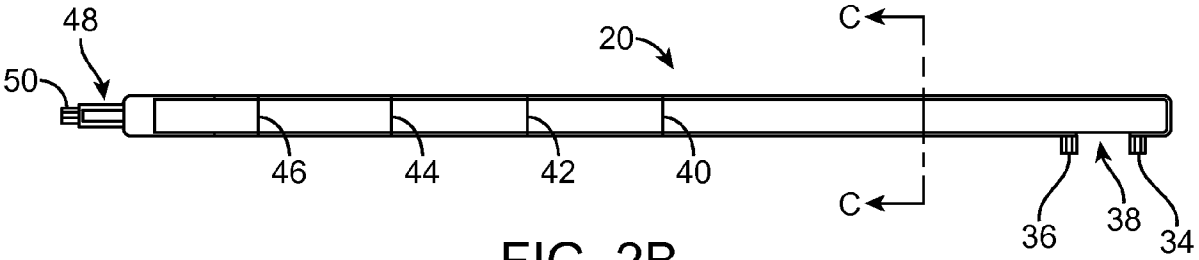
FIG. 2B is left side plan view of the divider shown in FIG. 1.
Figure 2C:
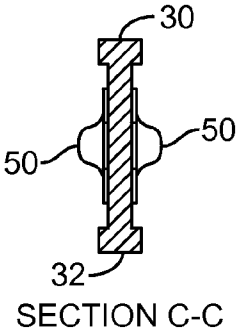
FIG. 2C is a cross-sectional view of divider shown in FIG. 1 taken along the line 'C-C' in FIG. 2B.
Figure 3:
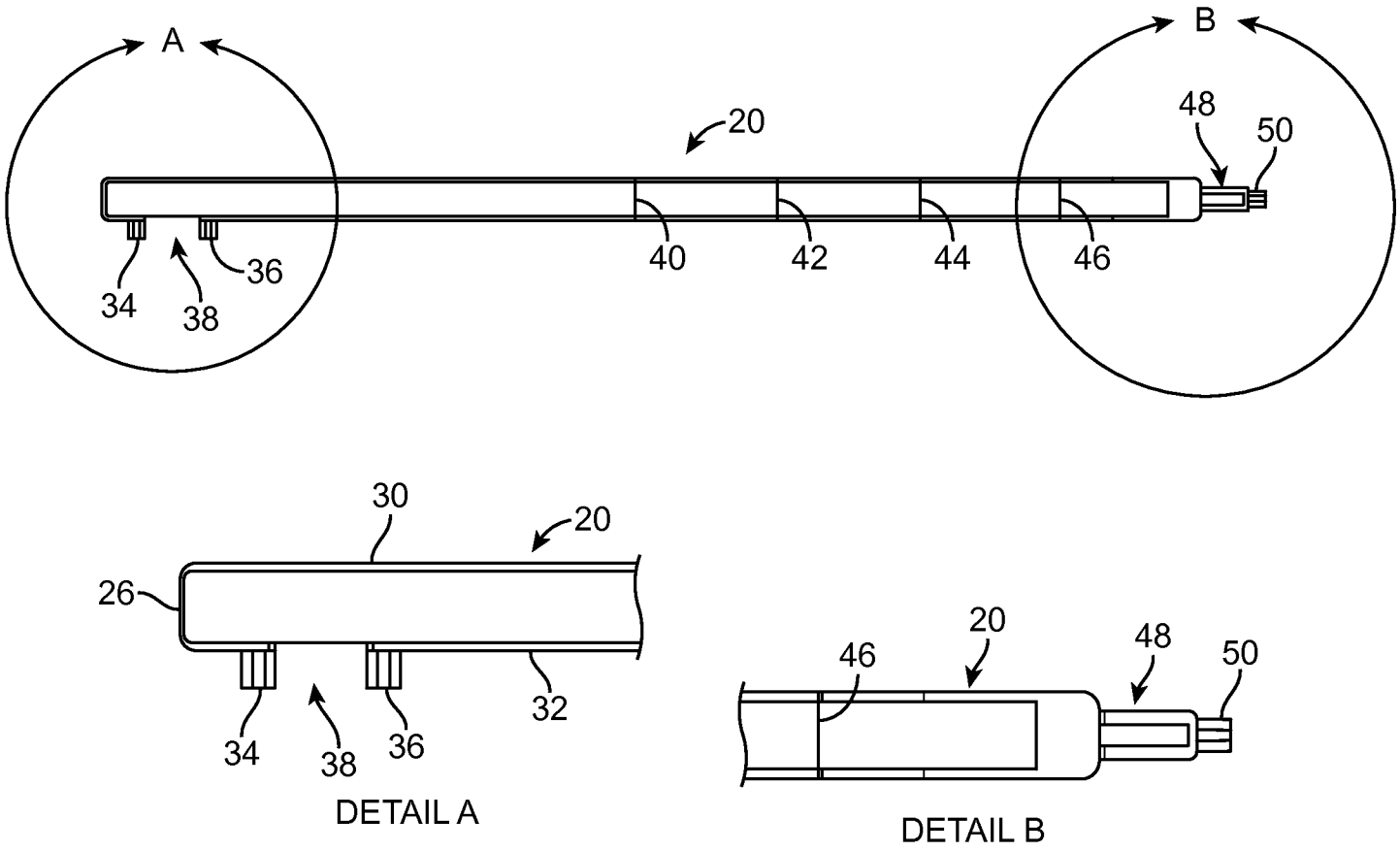
FIG. 3 is a duplicate of FIG. 2A, but additionally showing detailed views of portions circled as A and B.

There is shown in FIG. 1 a preferred embodiment of a divider in accordance with one embodiment of the present invention. The divider includes an elongate strip 20 possessing a pair of opposing side surfaces 22, 24, a front end surface 26 and an opposing rear end surface 28, and an upper surface 30 and an opposing lower surface 32. The upper surface 30 and the lower surface 32 preferably possess relatively thickened regions so that the cross-section of the elongate strip 20 possesses a somewhat "I-beam" profile, as is best shown in FIG. 2C. The I-beam configuration allows the strip 20 to be relatively thin, thereby reducing the amount of metal, plastic, or other material of which the strip 20 is fashioned, while maintaining strength and rigidity. As shown in FIG. 1, the front end surface 26 may also be relatively thickened.

Figure 13:
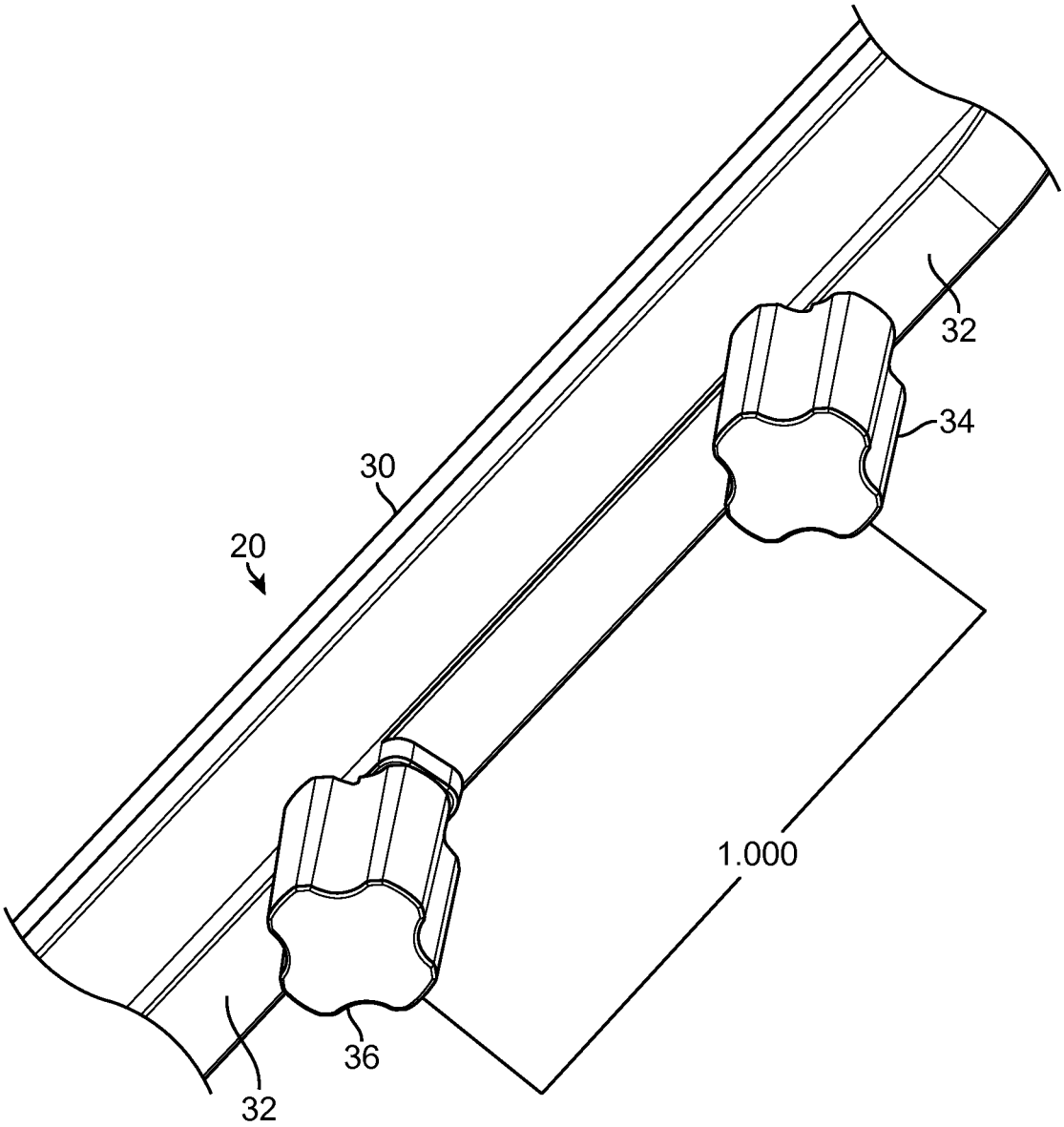
FIG. 13 is a different perspective view of the front portion of the divider shown in FIG. 12.
Figure 14:
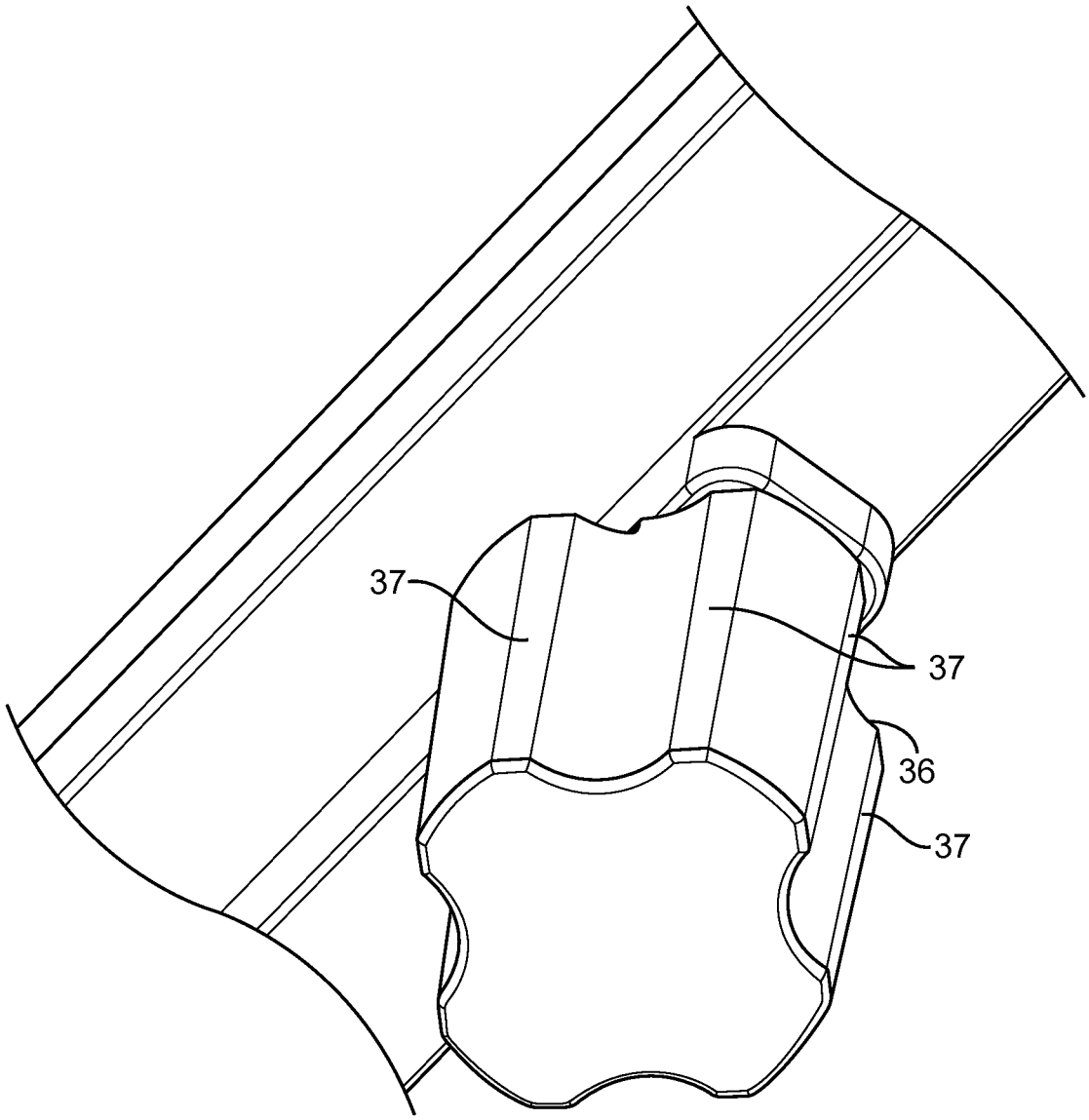
FIG. 14 is a close-up perspective view of a lug shown in FIG. 12.
Figure 15:
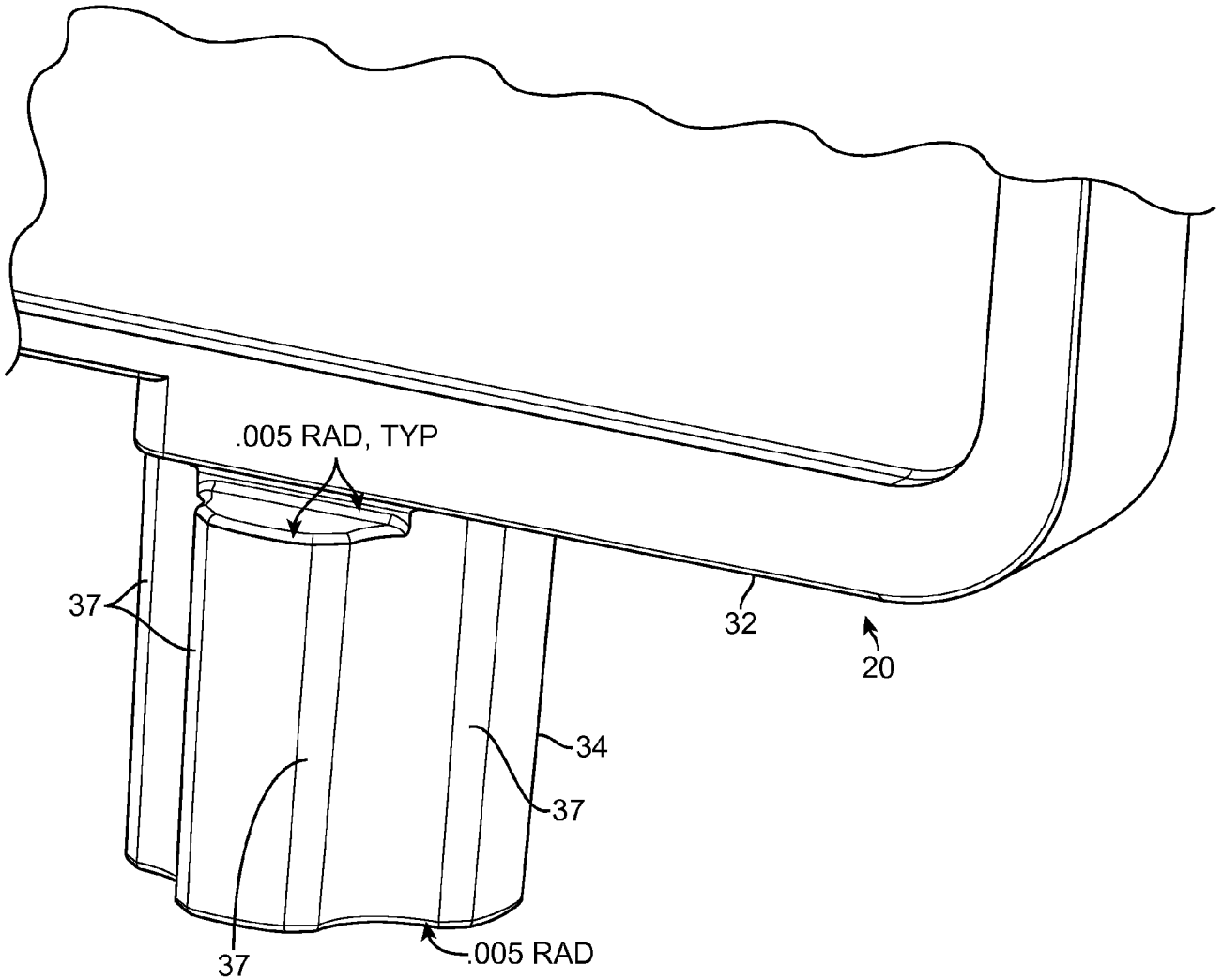
FIG. 15 is another close-up perspective view of a lug shown in FIG. 12.
Figure 16:
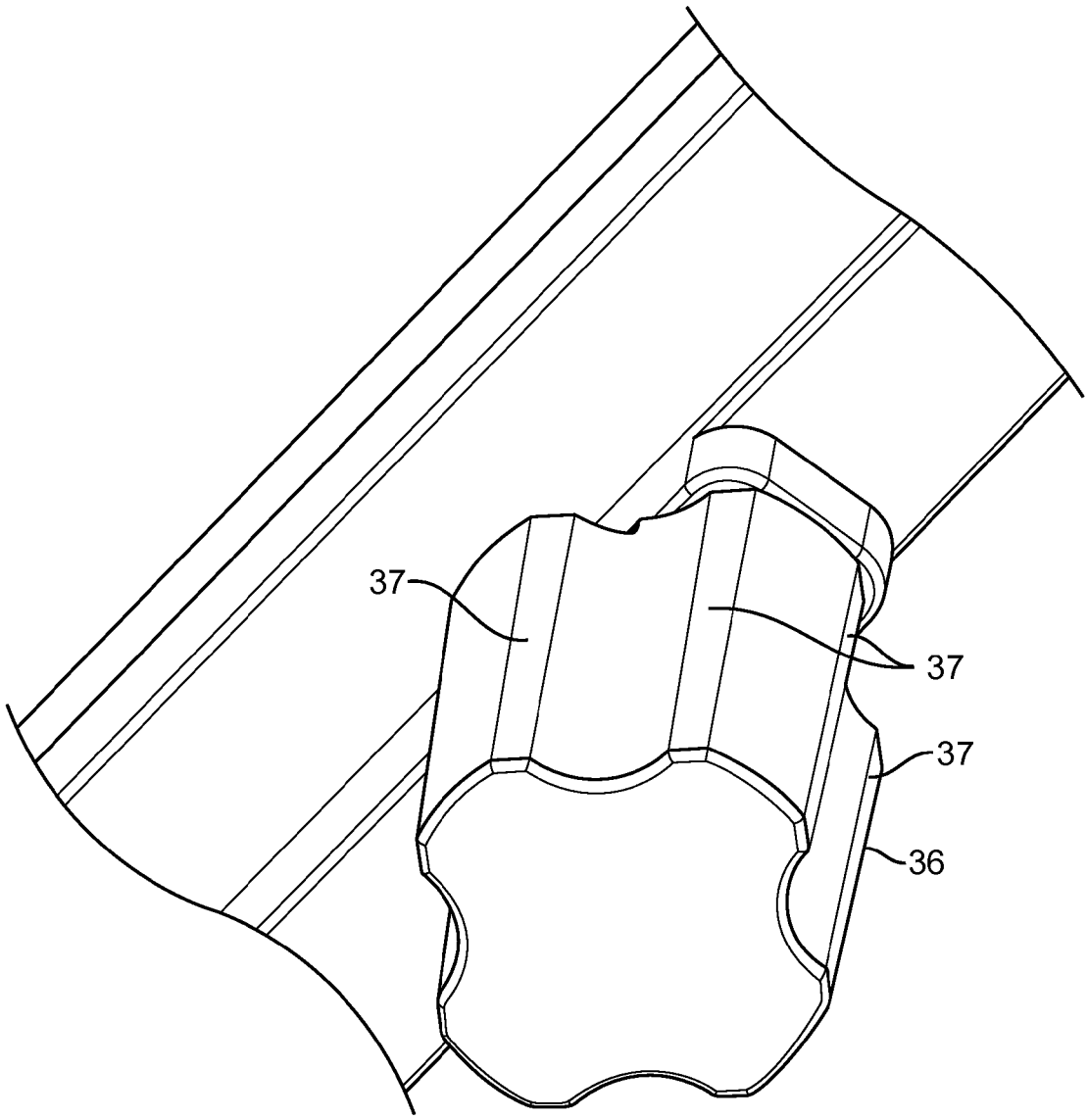
FIG. 16 is yet another close-up perspective view of a lug shown in FIG. 12.

As best shown in FIGS. 1 and 13, the strip 20 possesses a pair of generally cylindrically shaped front pins or lugs 34, 36 depending from the lower surface 32 near, but slightly away from, the front end edge 26. The lower surface 32 preferably possesses a recess 38 in the region between, very preferably extending completely between, the front lugs 34, 36. Preferably the recess 38 possesses a depth of about 0.04 to 0.18 inches and most preferably about 0.046 inches. The recess 38 permits a user to insert a screw driver or other appropriate tool between the shelf 10 and the lower surface 32 of the strip 20 so as to pry the strip 20 away from the shelf 10 so that the strip 20 may be re-used and moved to a different position on the same shelf 10 or to a different shelf. The spacing between the centers of each front lug 34, 36 is most preferably about either one inch or one and one-half inches. Such spacing best accommodates the spacings of arrays of apertures in common, commercial shelving products such as a Gondola shelf.

Figure 5:
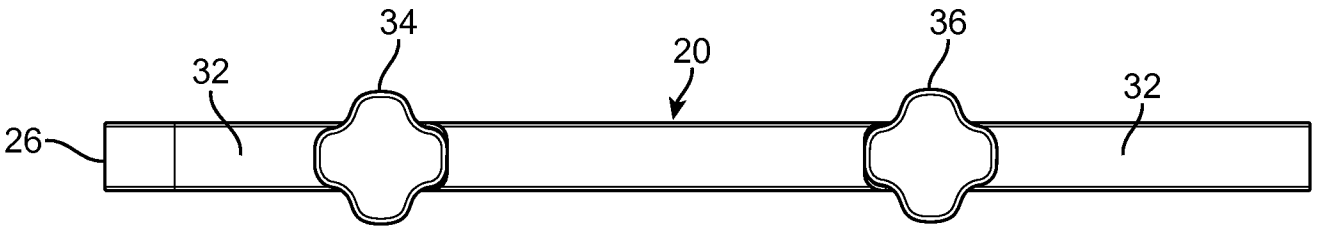
FIG. 5 shows a close-up view of the bottom plan view of the front portion of the divider as shown in FIG. 4B.
Figure 6:
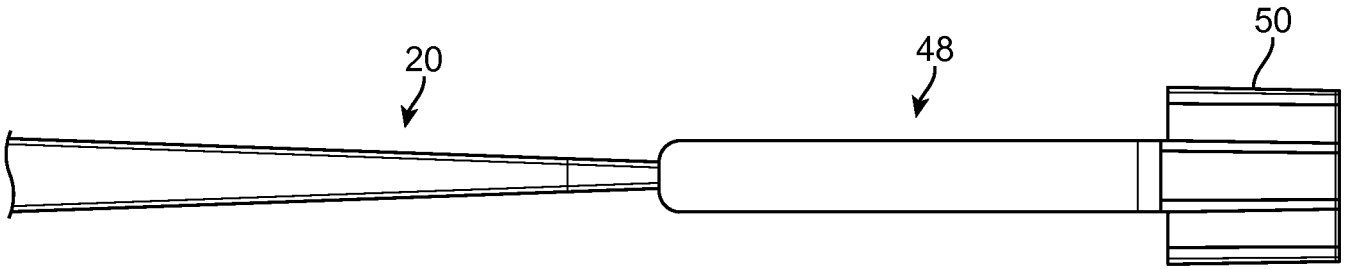
FIG. 6 shows a close-up view of the bottom plan view of the rear portion of the divider as shown in FIG. 4B.

As best shown in FIGS. 5 and 12-18, each front end lug 34, 36 preferably possesses a series of scallops and ridges extending longitudinally along the periphery of each of the front lugs 34, 36. The alternating scallops and ridges create a splined surface. Preferably, the ridges are equi-angularly spaced. In a particular one of the preferred embodiments of the present invention, the front lugs 34, 36 each possess four ridges that are equi-angularly disposed along the periphery, as best shown in FIGS. 5 and 13. As such, the ridges create a "cross" profile when viewed from the distal ends of the front lugs 34, 36, or when viewed in cross-section of the front lugs 32, 34 taken in a direction perpendicular to the longitudinal direction of the front lugs 34, 36. A pair of opposing arms of the cross shape are preferably co-extensive with the length of the strip 20, and the other opposing pair of arms are perpendicular to such strip length. The length between the distal ends of co-extensive arms of each cross of the profile at the lowest, distal end of each front lug 34, 36 is preferably about 0.234 to 0.238 inches and most preferably about 0.236 inches. Also, the peripherally distal end edges of each arm possess a rounded, contour, preferably substantially arcuate with a radius of curvature of about 0.10 to 0.13 inches, and most preferably about 0.118 inches, as best shown in FIGS. 5 and 12-16. The scalloped regions preferably are substantially arcuate with a radius of curvature preferably about 0.04 to 0.06 inches, and most preferably about 0.052 inches.

Each front lug 34, 36 possesses a preferably flat, planar, beveled or chamfered surface 37 between the rounded distal end of each arm and an adjacent scalloped region, as best shown in FIGS. 5 and 12-18. Each beveled surface 37 possesses a width of preferably about 0.115 inches. Preferably each beveled surface 37 extends preferably at an angle in the range of about 42 to 48 degrees, and most preferably 45 degrees, relative to the centerline of each opposing cross arm and relative to the extent of the length of the strip 20. As best shown in FIG. 18, opposing ones of the beveled surfaces 37 preferably abut opposing sides of the square or diamond shaped apertures 12. As such, the distance between opposing beveled surfaces 37 is preferably about 0.206 to 0.218 inches, and most preferably about 0.206 inches, at the lowest, distal end of each front lug 34, 36.

Also, as best shown in FIGS. 13-16 the peripheral edge of the lower, distal end of each front lug 34, 36 is rounded, preferably in an arcuate curve having a radius of about 0.004 inches to 0.006 inches, and most preferably about 0.005 inches. The rounded edge helps to center each front lug 34, 36 within an associated aperture 12 as the front lug 34, 36 is inserted therein.

Such a front lug 34, 36 profile configuration will accommodate either the circular, square, or diamond-shaped profiles of the apertures 12 in a large number of typical commercially available shelves 10. As previously mentioned, the spacing between the front lugs 34, 36 is selected so as to permit the insertion of the front lugs 34, 36 into corresponding ones of the apertures 12 in many typical commercial shelving arrays. Although two front lugs 34, 36 are preferred, the invention contemplates the use of any number of such lugs.

Preferably the outer peripheral profile of each front lug 34, 36 slightly tapers from the upper region of each front lug 34, 36 to the distal, lower end of each front lug 34, 36. Preferably the taper is about one to three degrees, most preferably about one degree. Also preferably the longitudinal length of each front lug 34, 36, i.e., the distance each front lug 34, 36 depends below the lower surface 32 is between about 0.230 inches to 0.260 inches, and most preferably about 0.240 inches. Further, the upper ends of each front lug 34, 36 that extend laterally from the strip 20 are recessed or truncated downwardly as best shown in FIGS. 12, and 14-16. Such a recess helps insure that the upper region of the front lugs 34, 36 does not extend above the top surface of the shelf, which otherwise might create an obstacle or obstruction with the placement or movement of the items on the shelf. Preferably the recess of the upper region of the front lugs 34, 36 depends about 0.002 to 0.015 inches, and most preferably about 0.010 inches, below the lower surface 32 of the strip 20.

The scalloping of the peripheral surface of the front lugs 34, 36 serves several purposes. The scalloping reduces the amount of material needed to fabricate the divider, and also makes it easier for the surface to cool and be removed from a mold during manufacture. Further, the scalloping helps to permit some deformity of the ridges in those situations where the front lugs 34, 36 are slightly compressively inserted into apertures in the shelf. Although the scallops have been previously described as preferably arcuate, they may possess a "V"-shape, a "U"-shape, an irregular shape, or virtually any shape of depression.

When the front end lugs 34, 36 are disposed in corresponding apertures 12 of the shelf 10, certain portions of the peripheral edges of the front end lugs 34, 36 snugly rest against, or slightly compressively against, the walls of the apertures 12, as best shown in FIGS. 17 and 18. Preferably each of the front lugs 34, 36 possesses a friction-fit relationship with the inner surface defining the associated one of the apertures 12. Such a fitting relationship between the front lugs 34, 36 and their associated, corresponding apertures 12 into which they are disposed, helps insure that the strip 20 will be maintained in an upwardly extending relationship relative to the shelf 10 and inhibits the strip 20 from being easily dislodged from its selected position on the shelf 10. The invention also contemplates that the distal tips at the front lugs 34, 36 may possess a slightly bulbous configuration that may extend slightly below the shelf. The bulb portion may be at least slightly deformable, thereby creating a snap-fit connection of the front lugs 34, 36 with the shelf. Preferably the snap-fit is not a permanent connection, but rather, is releasable whereby the bulbous portion may be retracted back through the aperture so as to enable the divider to be reused.

As is best shown in FIGS. 1, 2A and 2B, 3 and 4A and B, 9, 10, and 11, the strip 20 may possess one or more score lines 40, 42, 44, 46 each extending from the upper surface 30 to the lower surface 32 preferably in a direction that is perpendicular to the longitudinal extent of the elongate strip 20. Score lines 40, 42, 44, 46 preferably comprise relatively thin regions of the strip 20 and may comprise a continuous line of relatively thin, weakened material, a discontinuous series of relatively thin, weakened material, a series of perforations through the strip 20, or any other features familiar to those skilled in the art.

The score lines 40, 42, 44, 46 are designed and adapted to permit a user of the divider to manually snap or break the strip 20 at a particular one of the score lines 40, 42, 44, 46 so as to choose an effective length of the remaining strip 20 that best accommodates the depth of the shelving 10 on which the divider is to be used. As such, the score lines 40, 42, 44, 46 may be equi-distantly spaced along the strip 20, but also may be positioned at other locations as well, as best accommodates the most typical or prevalent depths of commercial shelves 10, such as ten inches and sixteen inches.

The rear end surface 28 of the strip 20 preferably possesses a fork-shaped tab 48 extending therefrom. A distal end of the tab 48 possesses a rear pin or lug 50 preferably in all respects identical to the configuration of the front lugs 34, 36. The fork-shaped tab 48 is preferably attached to the rear end surface 28 by a score line or by a relatively thin region of material, so that a person may press the tab 48 in a manner such that the tab 48 snaps and disattaches from the rear end surface 28 along the weakened region. It should be appreciated that the invention contemplates that the tab 48, before detachment, may be positioned at locations other than the rear end surface 28 of the strip.

Figure 11A:
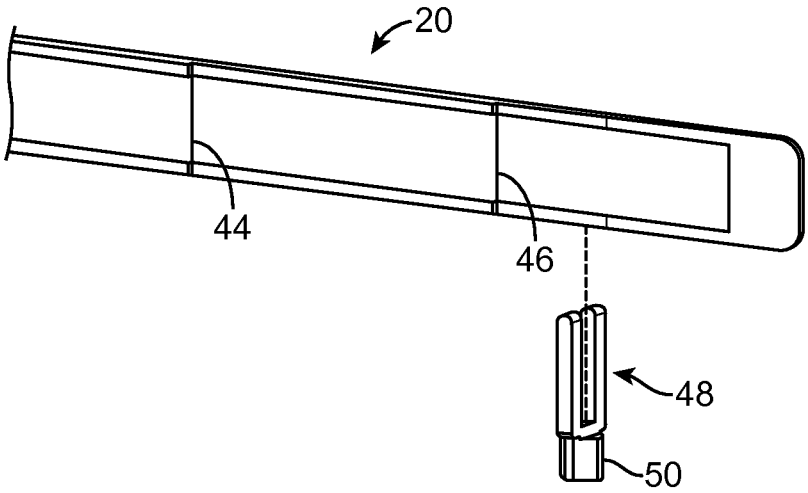
FIGS. 11A and 11B are illustrations of how a back pin detached from the rear of the divider shown in FIG. 1 may be used to support the remainder of the divider.
Figure 11B:
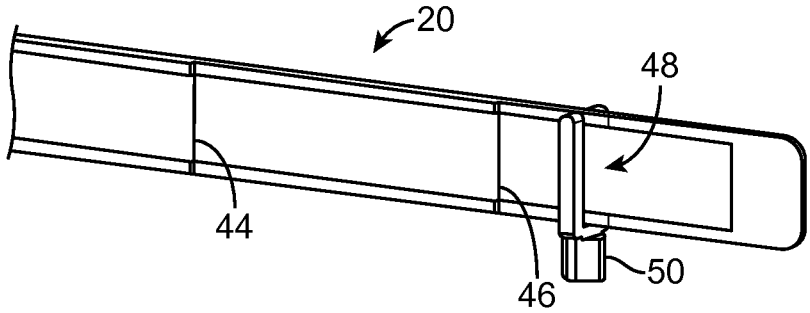
Figure 12:
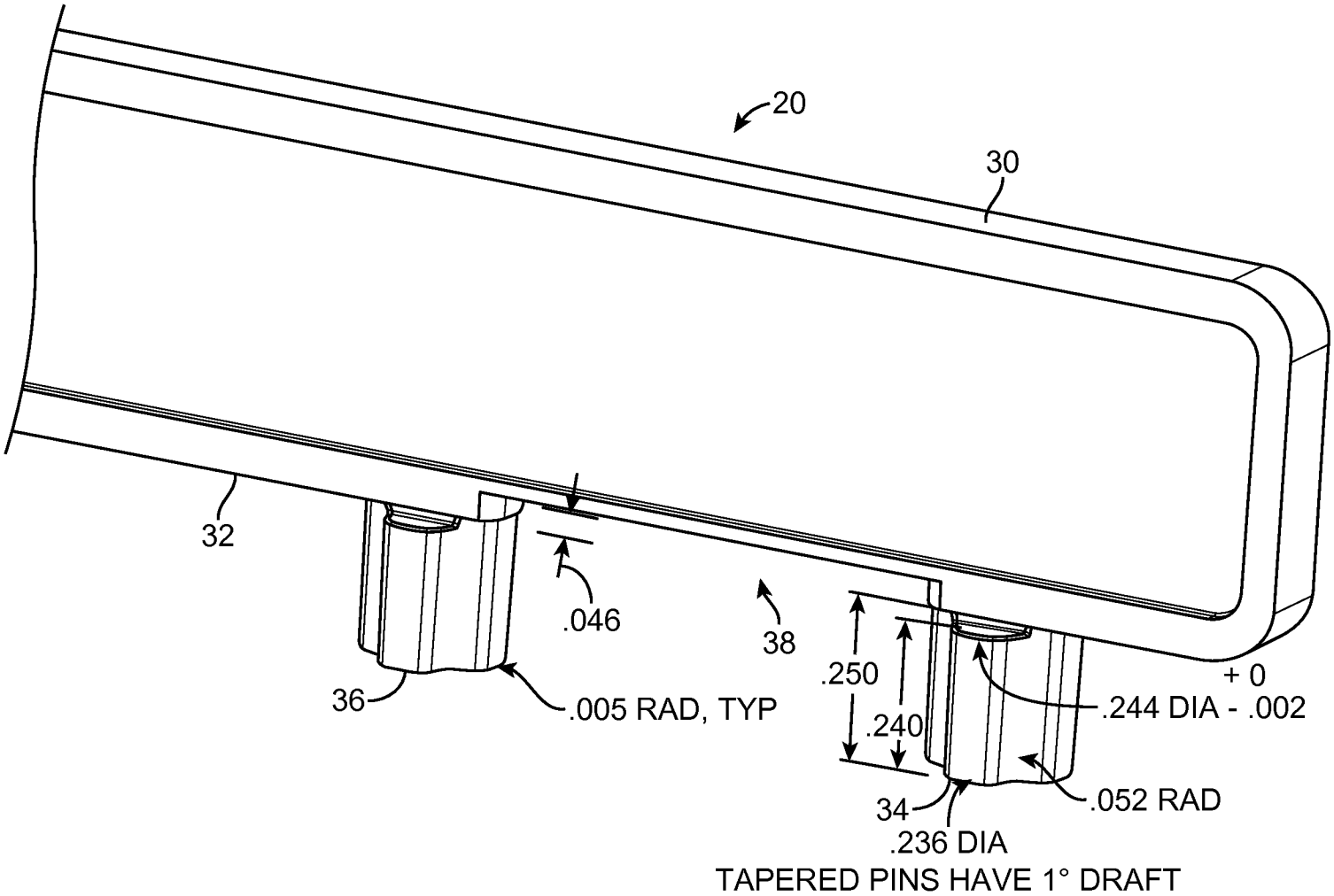
FIG. 12 is a perspective view of the front portion of the divider shown in FIG. 1 that depicts more details of the lugs shown in FIG. 5.

The detached tab 48 may be employed by inserting the rear lug 50 into an associated, corresponding aperture 12 in the shelf 10 and such that the remaining portion of the strip 20 may rest within, and be confined by, the fork portion of the detached tab 48, as best shown in FIGS. 11A and 11B. In a Gondola style shelve possessing a pair of rows of apertures along the rear shelf surface, the rear lug 50 may be selectively disposed within one of such rear row apertures. It will be appreciated that the distance between the fork segments of the tab 48 is approximately the same as, and preferably only slightly larger than, the lateral width of the strip 20 such that the remaining portion of the strip 20 is disposed and maintained in an upstanding relationship relative to the shelf 10. Although, as shown in FIGS. 11A and 11B, the detached tab 48 is selectively disposed toward the rear end of the remaining portion of the strip 20, it should be appreciated that the detached tab 48 may be positioned selectively along any point of the remaining portion of the strip 20.

The portion of the strip 20 rearward of the rearward-most score line 46 preferably possesses a profile that tapers laterally toward the tab 48, as best shown in FIGS. 1, 4A and 4B, 8, and 10. When the tab 48 is detached from the rear end surface 28 and when the rearward portion of the strip 20 is snapped and detached along the rearward-most score line 46, the detached rearward-most portion of the strip 20 may function as a wedge adapted to be inserted in the recess 38 between the front lugs 34, 36 and thereby function as a tool to pry the strip 20 away from the shelf 10.

Figure 7:
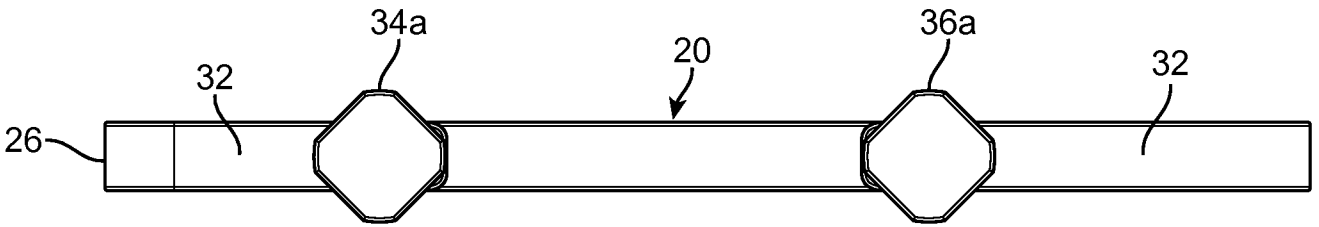
FIG. 7 shows a close-up view of the bottom plan view of the front portion of the divider as shown in FIG. 4B with a different lug configuration than that shown in FIGS. 5 and 6.
Figure 8:
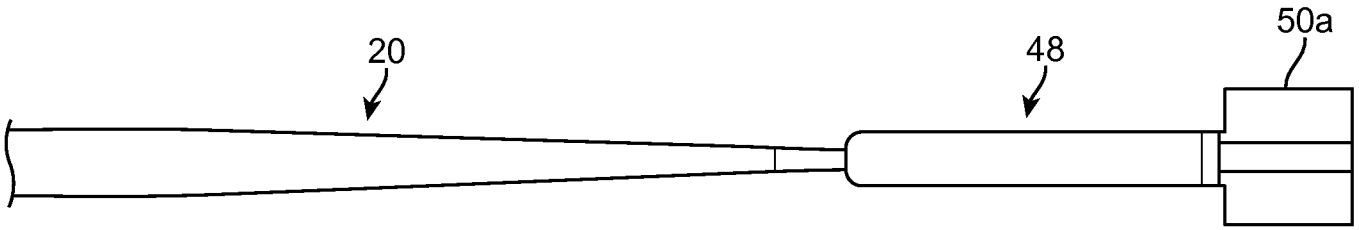
FIG. 8 shows a close-up view of the bottom plan view of the rear portion of the divider as shown in FIG. 4B with a different lug configuration than that shown in FIGS. 5 and 6.

FIGS. 7 and 8 depict yet another embodiment of the present invention which is in all respects similar to the previously described embodiment, with the exception that the front lugs 34*a*, 36*a* and the rear lug 50*a* possess a different profile. As best shown in FIG. 7, the front lugs 34*a*, 34*a* possess a generally square profile with the corners chamfered with a slightly rounded contour. Each diagonal length of the square profile is preferably about 0.234 to 0.238 inches, and most preferably about 0.236 inches. One diagonal of the square profile extends preferably coextensive with the length of the strip 20, and the other diagonal extends preferably perpendicular to such strip length. Likewise, the rear lug 50*a* shown in FIG. 8 possesses the same profile as the profiles of the front lugs 34*a*, 36*a*.

The divider is also useful to help initially arrange items on a shelf in a line from front to back on the shelf. When so used, the divider is preferably oriented with the opposing side surfaces 22, 24 in a relatively horizontal position, parallel with the shelf. A person then manually moves the divider horizontally so that either the upper surface 30 or the lower surface 32 contacts items resting on the shelf. Since the upper surface 30 and the lower surface 32 are straight, continued movement of the divider causes the items being contacted to align in a straight line. This technique is especially useful when one divider is installed on a shelf and another divider is used to move and swipe adjacent items toward the installed divider. The divider used for swiping the items into an aligned, abutting relation with the installed divider may then itself be installed on the shelf, adjacent to the items on the side opposite to the previously installed divider.

Figure 4A:
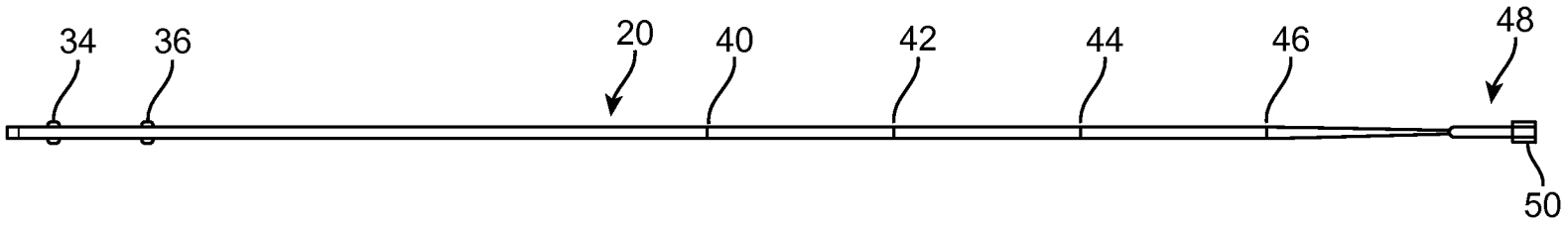
FIG. 4A is top plan view of the divider shown in FIG. 1.
Figure 4B:
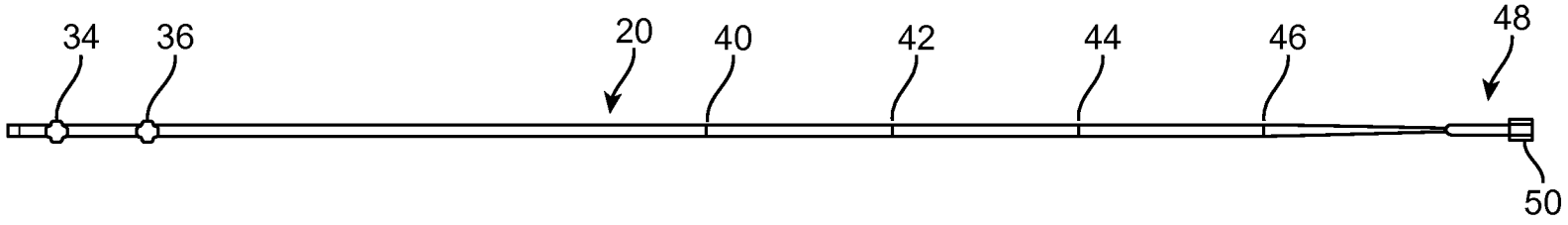
FIG. 4B is bottom plan view of the divider shown in FIG. 1.

In a preferred embodiment, the divider possesses a lateral thickness of about 0.10 to 0.20 inches and most preferably about 0.125 inches in the thickened region at the upper and lower surfaces 30, 32 and a lateral thickness of about 0.05 to 0.10 inches and most preferably about 0.070 inches in the relatively thin interior region between the opposing side surfaces 22, 24. Such a configuration helps maintain the strength and rigidity of the divider, reduce manufacturing costs, and also preserve a relatively thin lateral profile of the divider, as best shown in FIGS. 4A and B. It will be appreciated that, when considering the value of shelf space in a retail store, the relatively thin profile of the divider occupies very little shelf space, thereby permitting the shelf space to be more efficiently utilized for storing and displaying items.

The vertical height of the divider above the shelf, that is, the vertical height of the strip 20 is preferably in the range of about one-half inch to three inches, and most preferably about one inch, although the invention contemplates a wide range of heights that are best suited to accommodate the vertical distance between adjacent shelves in a rack of shelves and the need to provide an abutting surface for items at a particular distance above the shelf.

Figure 19:
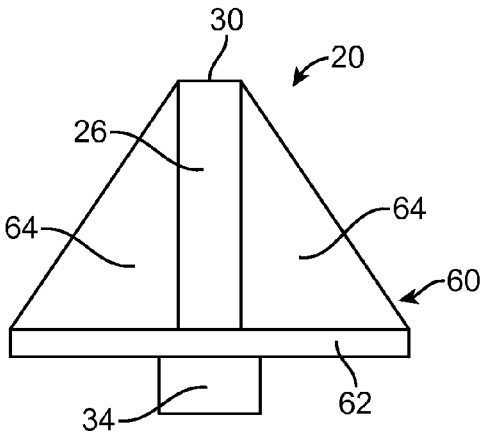
FIG. 19 is an end view of a divider according to another embodiment of the present invention.
Figure 20:
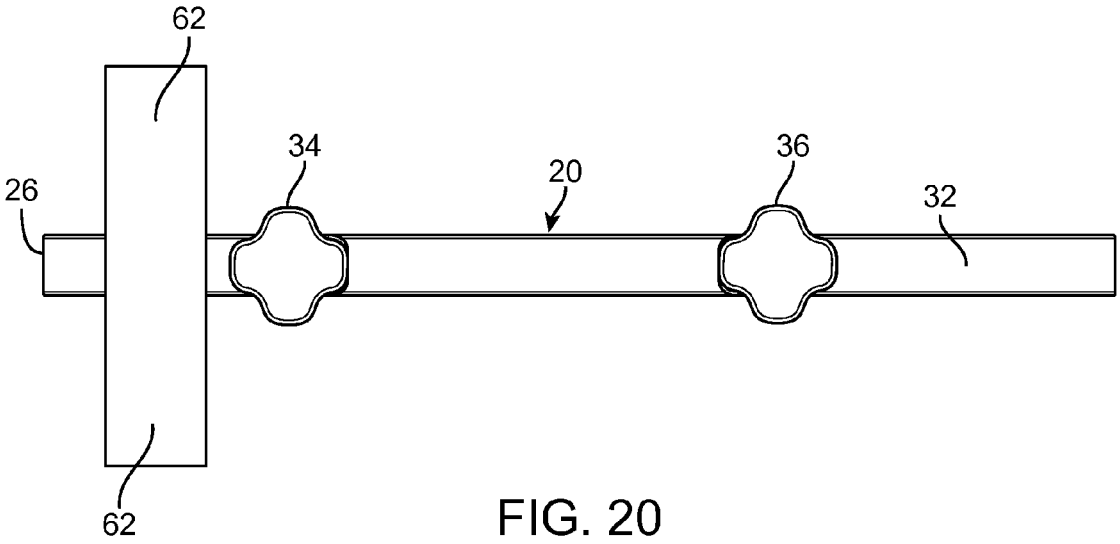
FIG. 20 is a partial bottom view of the divider shown in FIG. 19.
Figure 21:
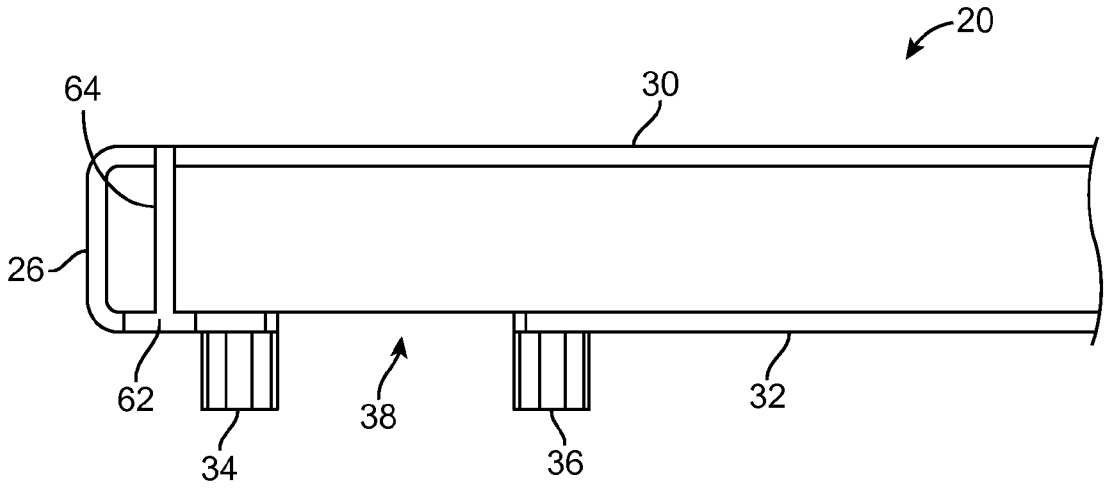
FIG. 21 is a partial side view of the divider shown in FIG. 19.

FIGS. 19-21 depict yet another embodiment of the present invention which includes a footer 60 preferably positioned near the front end surface 26 of the strip 20 and preferably integrally formed with the strip 20. The footer 60 preferably includes a plate-like base 62 that may possess a substantially rectangular configuration, as best shown in FIG. 20. The lower surface of the base 62 preferably is substantially planar and at an angle substantially perpendicular to the vertical extension of the strip 20 and is adapted to rest upon the surface of the shelf when the front lugs 34, 36 completely depend into associated apertures 12 in the shelf. When so situated, the base 60 provides support to help maintain the strip 20 in an upright position on the shelf. The base 62 preferably extends laterally outward from the strip 20 in the range of about three-sixteenths of an inch to one inch, and mostly preferably about five-sixteenths of an inch. The lateral extension of the base 20 also provides an abutment resting above the surface of the shelf that inhibits items from sliding along and past the lip of the shelf and dropping off the shelf. Instead, the base 62 permits and promotes a person to grasp and lift the item from the shelf, thereby reducing spillage and breakage of items.

As best shown in FIGS. 19 and 21, the footer 60 may also include a pair of opposing webs or buttresses 64 extending preferably from the upper surface 30 of the strip 20 to an associated laterally outer end of the base 62. Preferably the buttresses 64 are integrally formed with the strip 20 and the base 62, but may be secured to the strip 20 and the base 62 by an adhesive or by heat-welding, for example. Although the buttresses 64 are each shown as having a triangular configuration, as shown in FIG. 19, and as being relatively thin when compared with the extent of the base 62, as shown in FIG. 21, the buttresses 64 may possess a variety of configurations such as a square and a variety of thicknesses. The buttresses 64 may also possess a hole or a void generally in the central region thereof, which will reduce the amount of material used to fabricate the buttresses 64 while substantially maintaining the supporting strength of the buttresses 64. It will be appreciated that the buttresses 64 help strengthen the base 62 and inhibit flexing of the base 62 relative to the strip 20 and also aid in providing an inhibition against items sliding off the front edge of the shelf.

Although a single footer 60 is shown in FIGS. 19-21, the invention contemplates that additional footers 60 may be employed along the length of the strip 20 and that the footer 60 or footers 60 may be positioned other than near the front end surface 26 of the strip 20. The invention also contemplates that the footer 60 may extend laterally from only one lateral side of the strip 20.

Preferably the strip 20 is fashioned of plastic, metal, or a composite material. Preferably also, all the portions of strip 20 are integrally formed, including, but not limited to, the front lugs 34, 36, and the tab 48, including the rear lug 50. Also preferably, the entire strip 20 is formed by a plastic molding process.

Figure 22:
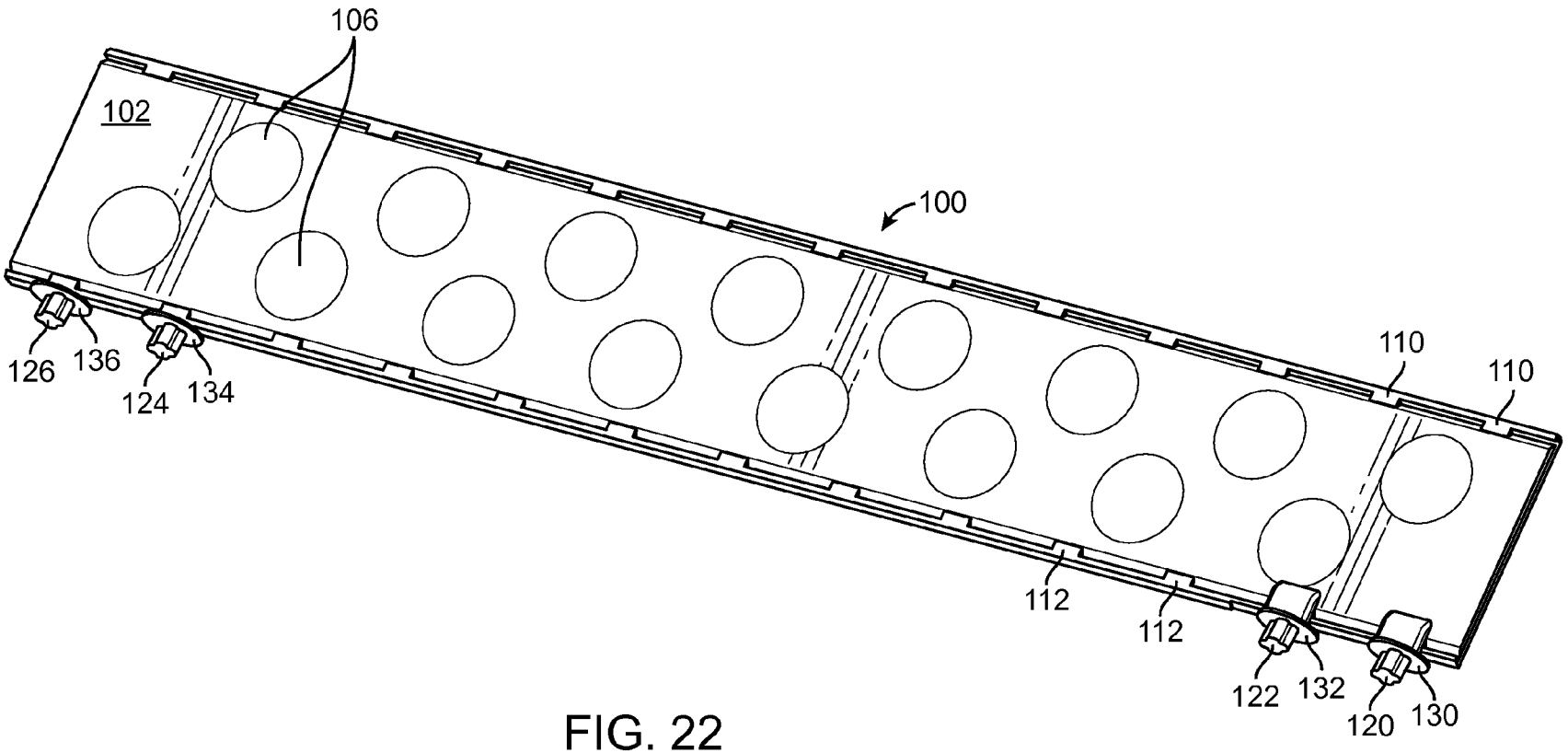
FIG. 22 is a perspective view of yet another embodiment of a divider according to the present invention.
Figure 23:
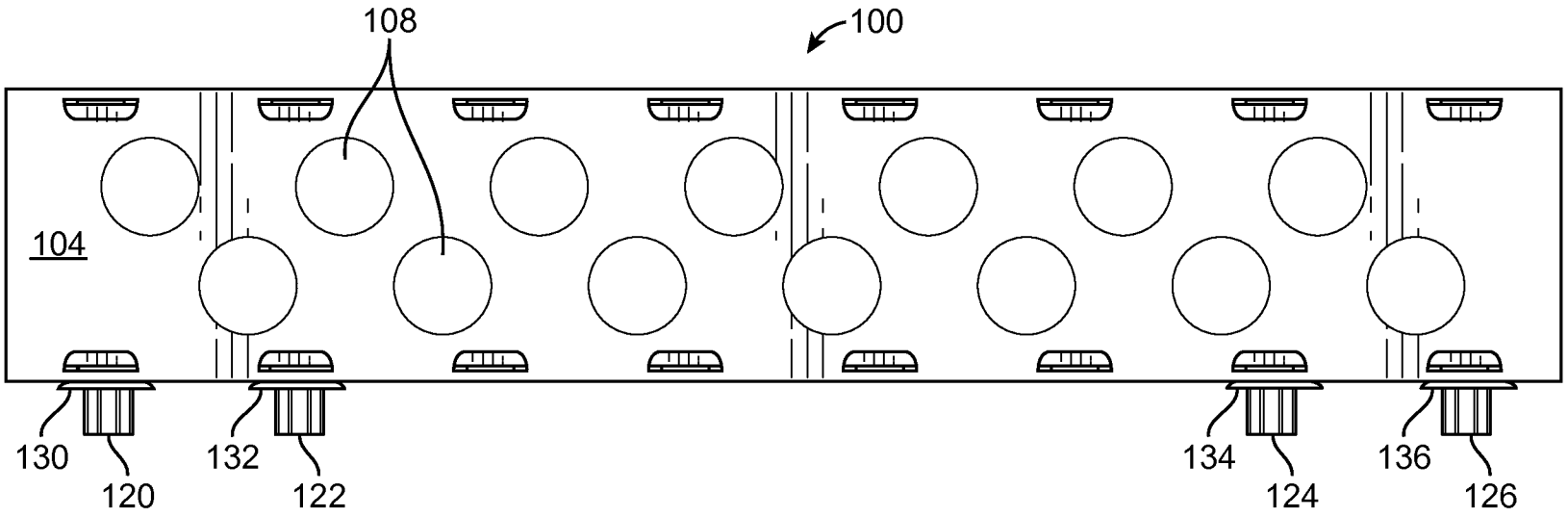
FIG. 23 is a right side elevational view of the divider shown in FIG. 22.
Figure 24:
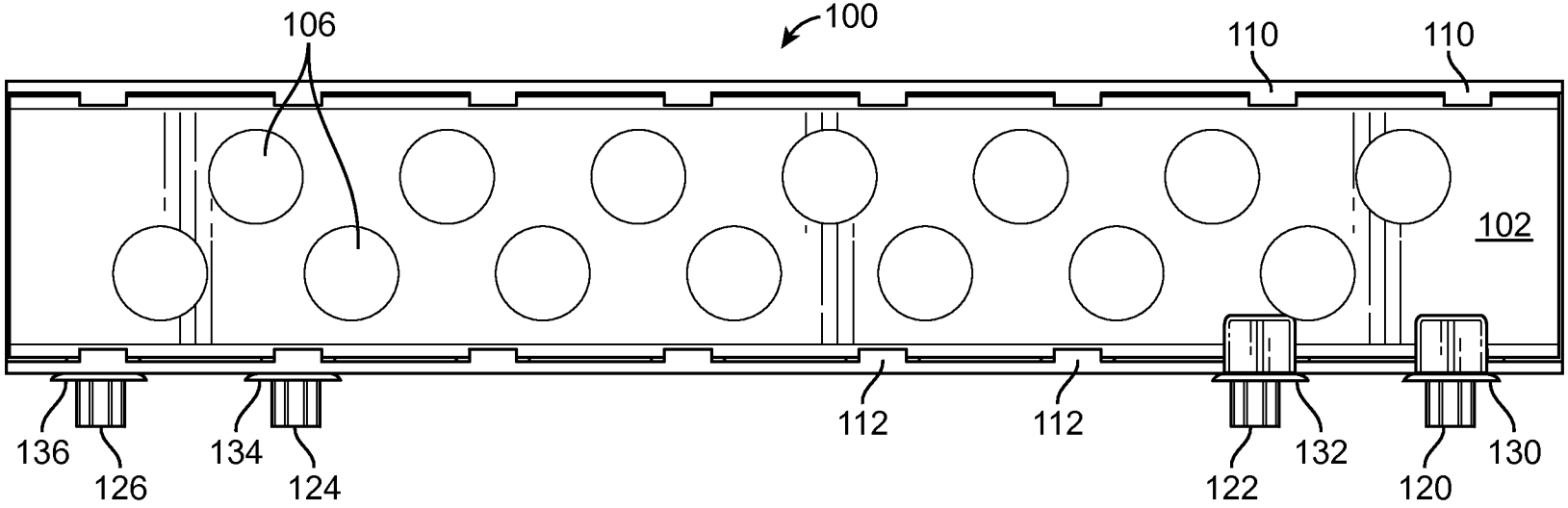
FIG. 24 is a left side elevational view of the divider shown in FIG. 22.
Figure 25:
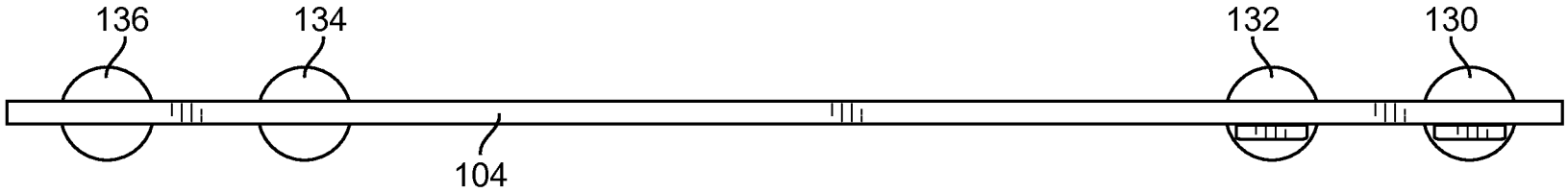
FIG. 25 is a top plan view of the divider shown in FIG. 22.
Figure 26:
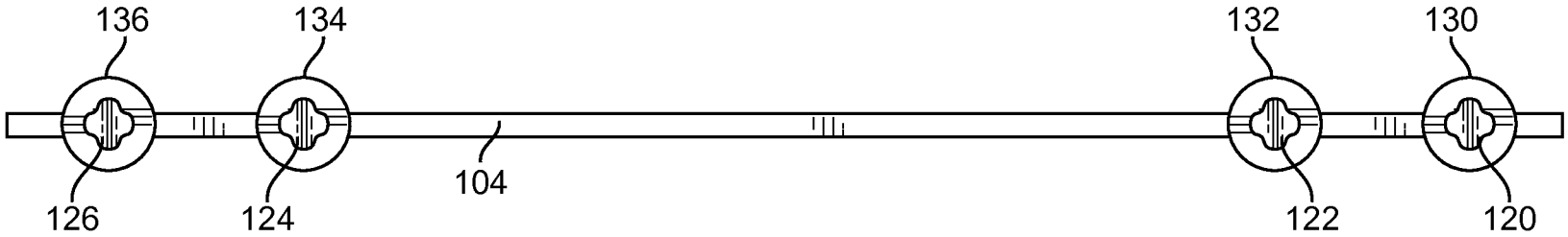
FIG. 26 is a bottom plan view of the divider shown in FIG. 22.
Figure 27:
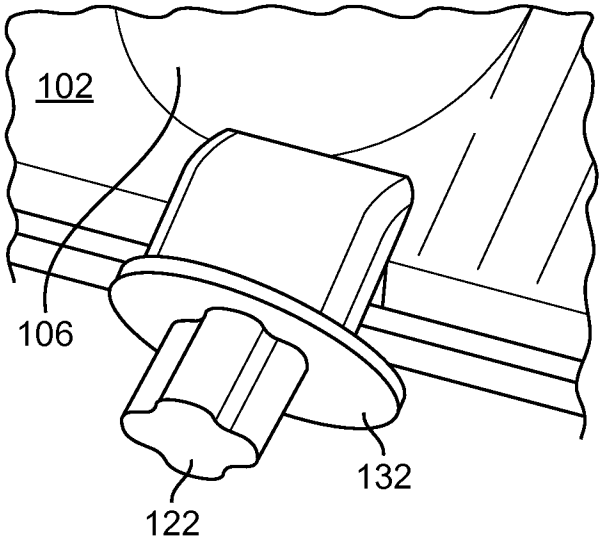
FIG. 27 is a partial perspective view of the divider shown in FIG. 22 depicting in better detail a lug.
Figure 28:
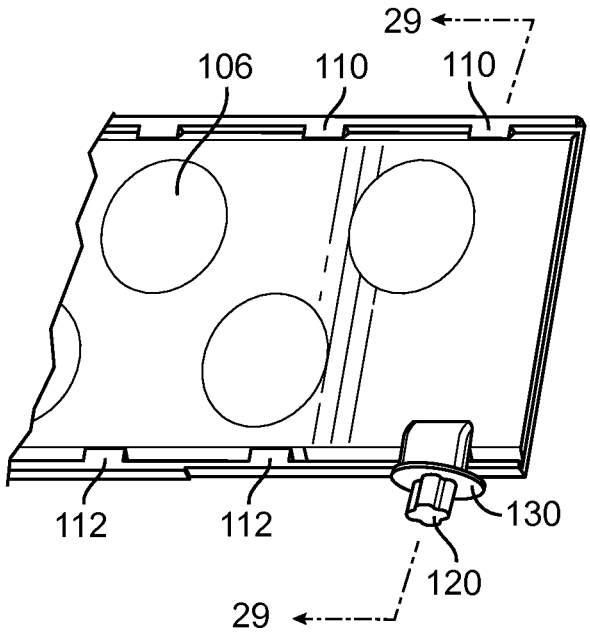
FIG. 28 is a partial perspective view of the divider shown in FIG. 37 depicting in better detail an end thereof.

There is shown in FIGS. 22-24 a divider 100 in accordance with yet another embodiment of the present invention. The divider 100 is removable and reusable. The divider 100 includes a first bar or strip 102 and a second bar or strip 104. The first strip 102 preferably comprises a relatively thin sheet of material configured with a rectangular periphery. The second strip 104 also preferably comprises a thin sheet of material configured with a rectangular periphery. Preferably the length of the second strip 104 is substantially equal to the length of the first strip 102, and the width of the second strip 104 is slightly larger than the width of the first strip 102.

Figure 29:
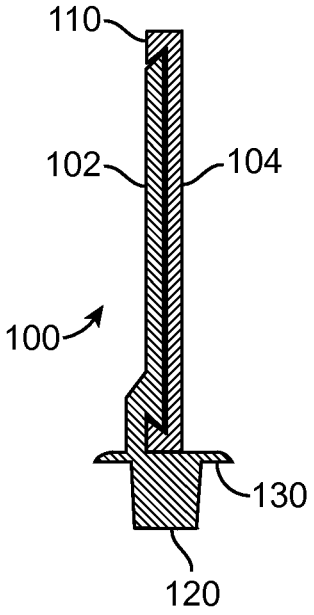
FIG. 29 is a cross-sectional view of the divider shown in FIG. 28 taken along the broken line designed 29.
Figure 31:
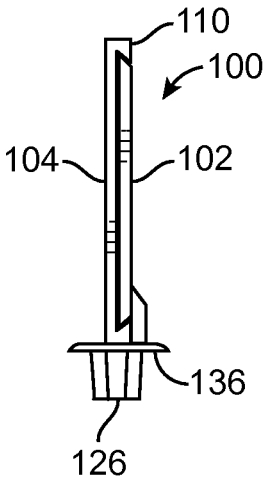
FIG. 31 is an end view toward one end of the divider shown in FIG. 22 and also toward one end of the divider shown in FIG. 37.
Figure 32:
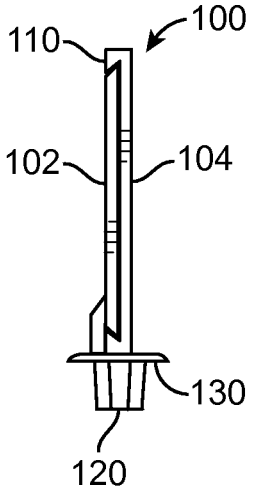
FIG. 32 is an end view toward the opposite end of the divider shown in FIG. 22 and also toward the opposite end of the divider shown in FIG. 37.
Figure 33:
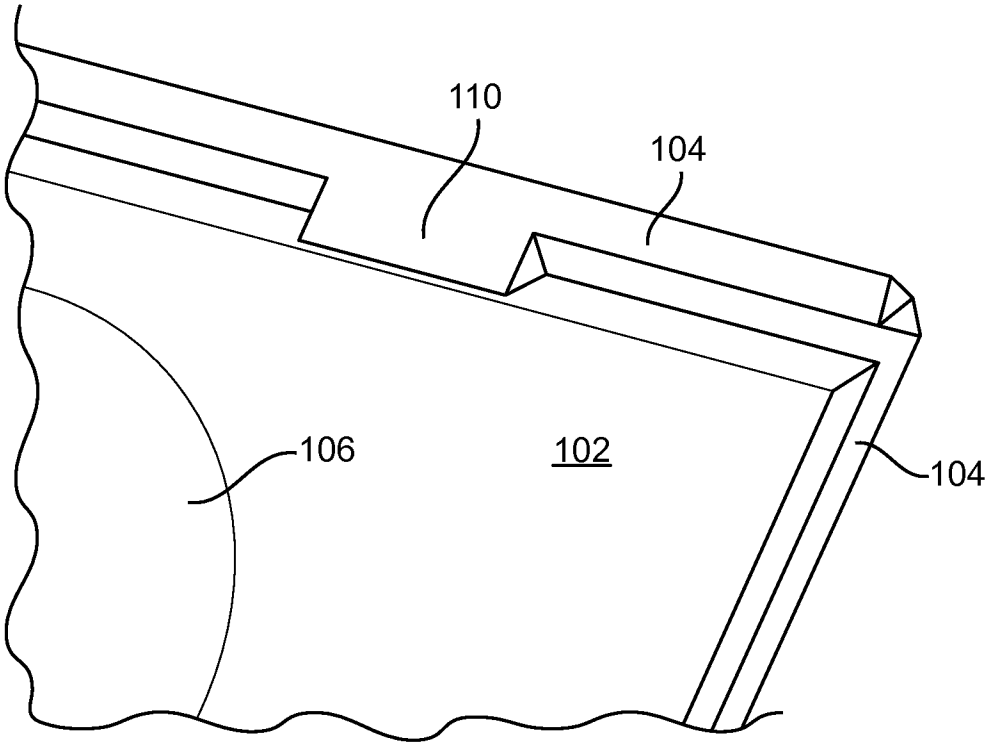
FIG. 33 is a partial perspective view of the divider shown in FIG. 22 and also the divider shown in FIG. 37.
Figure 34:
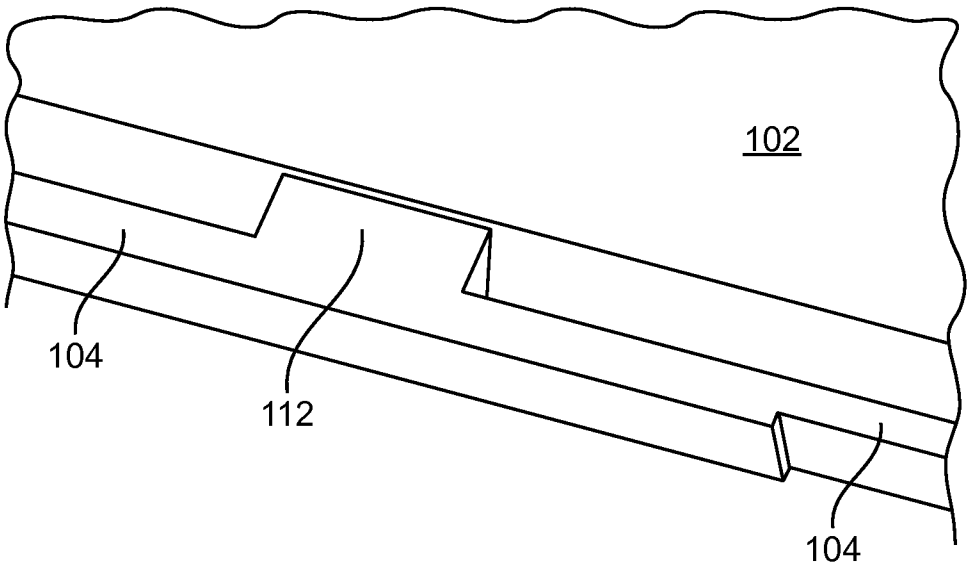
FIG. 34 is a partial perspective view of the divider shown in FIG. 22 and also the divider shown in FIG. 37.
Figure 35:
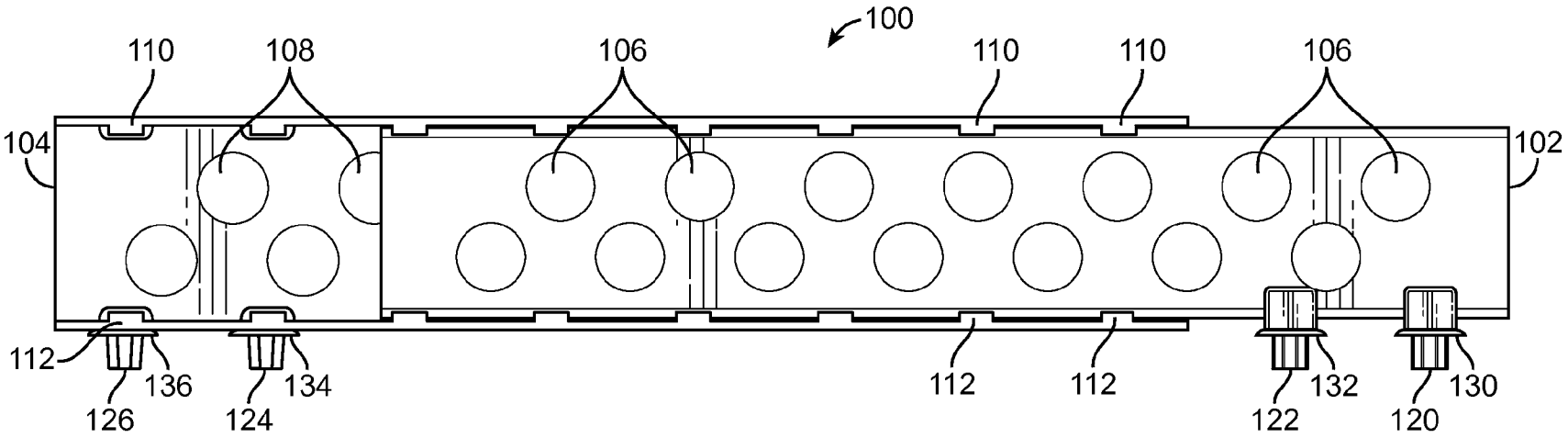
FIG. 35 is left side elevational view of the divider shown in FIG. 22 depicted in an extended condition from that shown in FIG. 24.

The two strips 102, 104 are preferably disposed in an overlapping relationship, such that one lateral surface of the first strip 102 faces and abuts a lateral surface of the second strip 104, as best shown in FIGS. 29, 31, and 32. The first strip 102 is adapted to slide along the second strip 104 such that the two strips 102, 104 are translatable with respect to each other, and such that the overall length of the divider 100 may be selectively adjusted from a collapsed state as shown in FIG. 22 to a partially extended state such as shown in FIGS. 35 and 36 and even to a fully extended state which is slightly less than twice the length of the divider 100 in the collapsed state.

As shown in FIGS. 22-24, each of the two strips 102, 104 possesses a series of apertures 106, 108, respectively, therethrough. The apertures 106, 108 function to minimize the amount of material used to manufacture the divider 100 and to reduce the weight of the divider 100, while still maintaining rigidity and strength of the strips 102, 104 and the overall divider 100. Accordingly, there may be any number of apertures 106, 108 and they may be any of a variety of configurations. Moreover, the apertures 106, 108 may be arranged in any array, although in FIGS. 22-24 they are shown in two parallel rows arranged equidistantly apart in each row and staggered longitudinally with respect to the adjacent row.

The first strip 102 is laterally restrained and contained by and with respect to the second strip 104 by means of a series of spaced fingers 110 disposed equidistantly along the upper region of the second strip 104 and another series of spaced fingers 112 disposed equidistantly along the lower region of the second strip 104. Each of the fingers 110, 112 preferably possesses the same configuration. As best shown in FIGS. 29-34, each finger 110, 112 is configured with a beveled surface, which is adapted to capture and retain an associated lateral edge of the first strip 102. Also as best shown in FIGS. 29-34, the upper linear edge and the lower linear edge of the first strip 102 are beveled. Preferably, the angle of beveling of the upper edge and the lower edge of the first strip 102 is substantially equal to the angle of beveling of the upper fingers 110 and the lower fingers 112 of the second strip 104. It will be appreciated that the first strip 102 may be slid longitudinally along a second strip 104 such that the upper beveled edge of the first strip 102 is captured by and abuts the beveled surface of the upper fingers 110 of the second strip 104 and such that the lower beveled edge of the first strip 102 is captured by and abuts the beveled surface of the lower fingers 112 of the second strip 104. As such, the first strip 102 is restrained from upward and downward movement relative to the second strip 104 and is restrained from lateral movement away from the second strip 104. Nevertheless, the first strip 102 is allowed to slide and translate longitudinally with respect to the second strip 104.

It will be appreciated that in the embodiment of the divider 100 as shown in FIG. 22, the first strip 102 possesses a pair of spaced lugs 120, 122 disposed and depending from the lower edge thereof, toward one longitudinal end thereof. Similarly, the second strip 104 possesses a pair of spaced lugs 124, 126 disposed and depending from a lower region thereof toward one longitudinal end thereof. The lugs 120, 122, 124, 126 may be similar in all respects to the lugs that have been previously described herein in respect to other embodiments of the present invention.

With reference to FIG. 36, it will be appreciated that the divider 100 may be extended by translating the first strip 102 relative to the second strip 104 such that the lugs 120, 122, 124, 126 may be aligned with and over the apertures in rows of apertures in the shelf 10 and such that the lugs 120, 122, 124, 126 may be inserted into an associated one of the apertures 12 so as to selectively maintain the divider 100 in a position extending upright along the shelf 10. Designing the divider 100 to be effectively extensible allows the divider 100 to be utilized in a wider variety of shelves 10 in which the spacing between the rows of the apertures 12 differs or varies.

Figure 30:
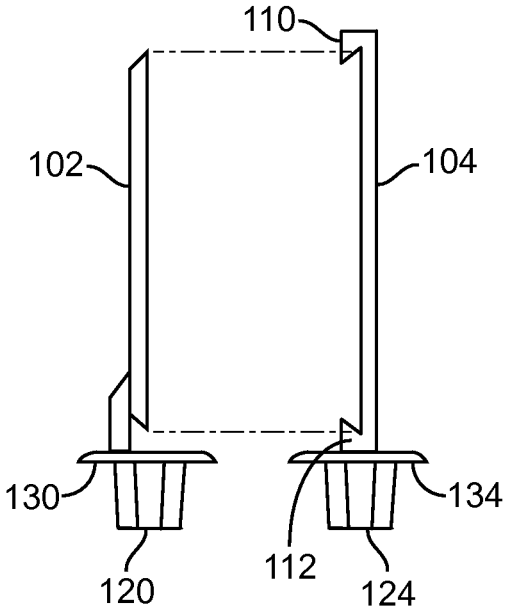
FIG. 30 is an exploded end view toward one end of the divider shown in FIG. 22 and also toward one end of the divider shown in FIG. 37.

It will also be appreciated that in the embodiment shown in FIGS. 22-24, the divider 100 includes a circular disc or cap 130, 132, 134, 136 immediately above each lug 120, 122, 124, 126, respectively. The lower surface of each cap 130, 132, 134, 136 is preferably flat and is adapted to rest on and against the shelf 10 and to provide a footing that helps to maintain the divider 100 in an upright position relative to the shelf 10. It will be appreciated from a review of FIGS. 29-32 that the lugs 120, 122 and the associated caps 130, 132 depending from the first strip 102 are slightly laterally offset a distance substantially equal to the thickness of the first strip 102 so that when the first strip 102 is positioned in an abuting, slideable relationship with respect to the second strip 104, all of the lugs and associated caps are in a linear alignment with respect to the overall divider 110 and further so that the lugs will be properly aligned with respect to the apertures 12 in the shelf 10 and in each of the rows of apertures 12 as shown in FIG. 36. Also, as best shown in FIG. 30, the lugs 120, 122 depending from the first strip 102 are slightly spaced from the lower beveled edge of the first strip 102 so that they are maintained in the same vertical position as the lugs 122, 124 depending from the second strip 104 and further so that all of the lugs and all of the caps of the overall divider 110 are designed to extend equidistantly into the apertures 12 in the shelf 10 and to each rest upon the top surface of the shelf 10, respectively.

Figure 37:
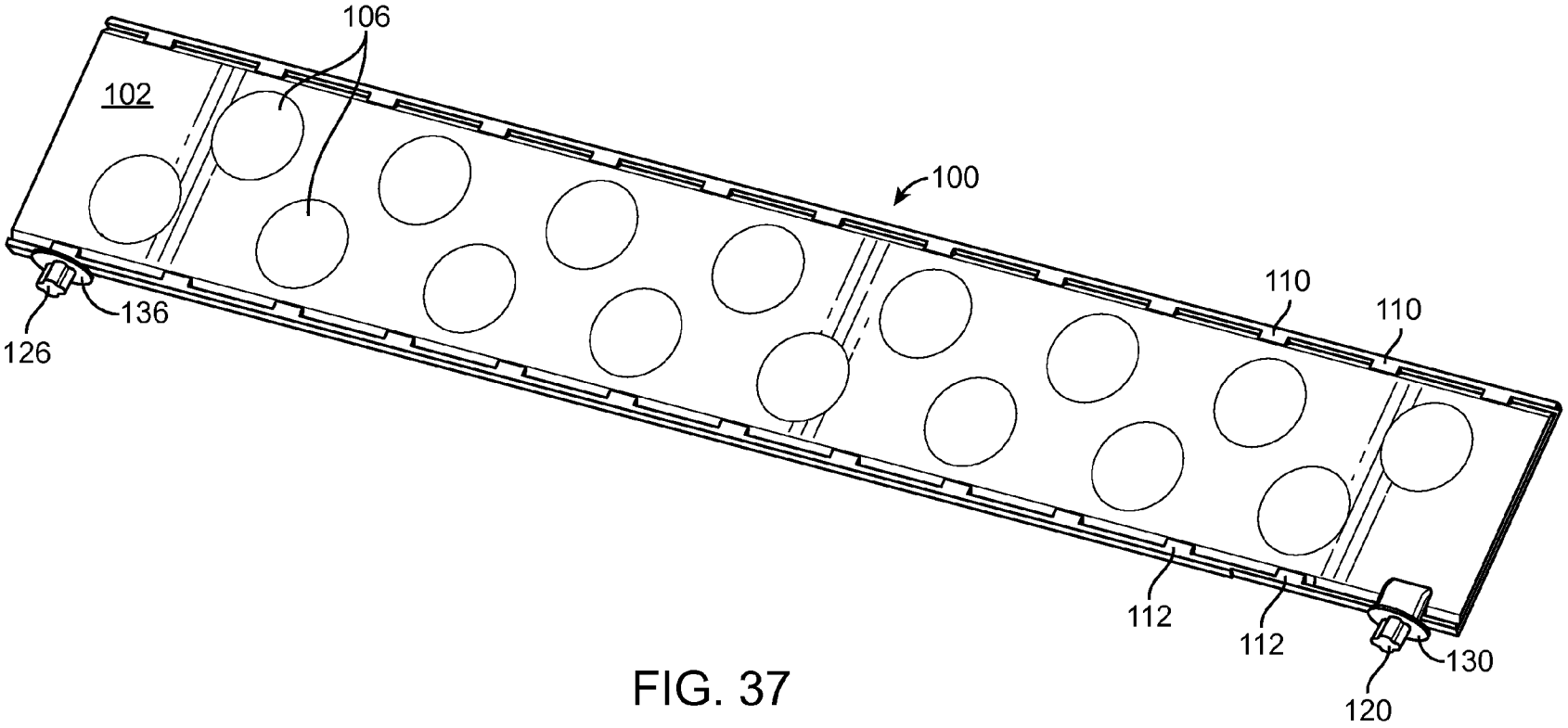
FIG. 37 is a perspective view of yet another embodiment of a divider according to the present invention.
Figure 38:
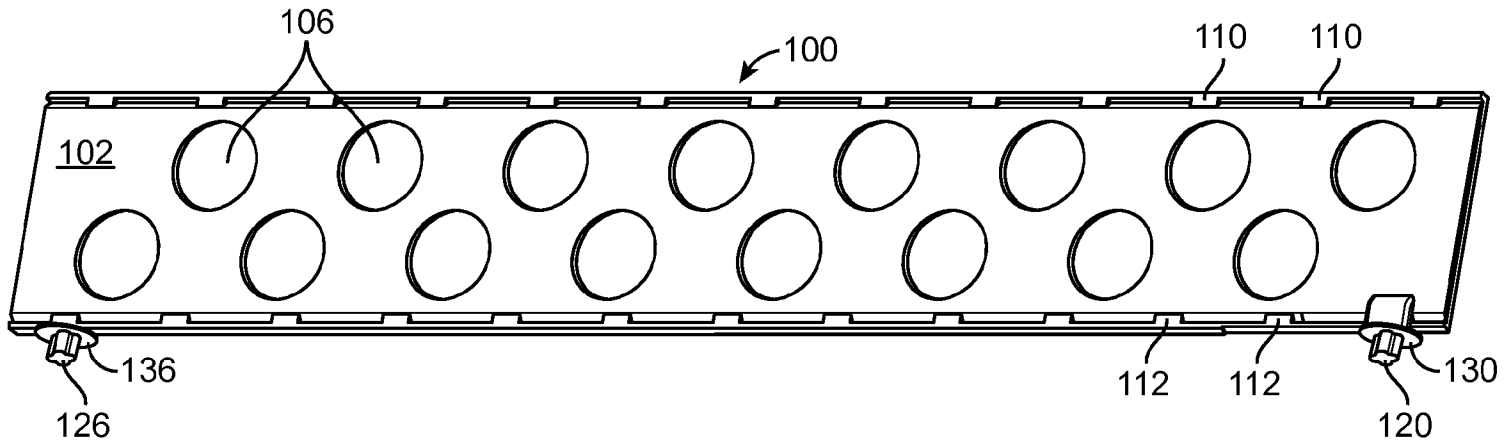
FIG. 38 is a right side elevational view of the divider shown in FIG. 37.
Figure 39:
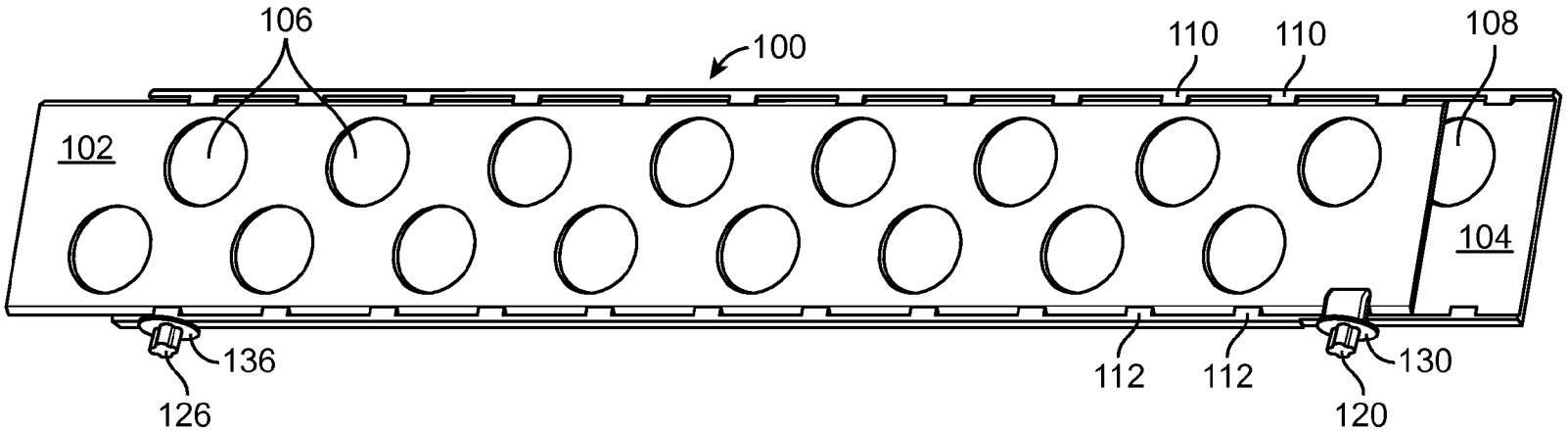
FIG. 39 is a left side elevational view of the divider shown in FIG. 37.

The embodiment shown in FIGS. 37-39 is in all respects similar to the embodiment shown in FIGS. 22-24 except that the first strip 102 is provided with only a single lug 120 and associated cap 130, and the second strip 104 is provided by only a single lug 126 and associated cap 136. With respect to FIG. 39, it will be appreciated that although the overall length of the divider 100 is extended, the distance between the lugs 120, 126 is decreased, thereby providing more flexibility and adaptability in accommodating different arrays and spacings of apertures 12 in a shelf 10.

It will be appreciated from FIGS. 29-34 that the configurations of the first strip 102 and the second strip 104 provide what may be referred to as a "dovetail" guide or slide.

Preferably, both the first strip 102 and the second strip 104 are fashioned of thin, transparent plastic, but may be fashioned of other materials such as other types of plastics, metal, or a composite material. Also, preferably each of the strips 102, 104 may be formed by plastic molding process.

While exemplary embodiments have been presented in the foregoing description of the invention, it should be appreciated that a vast number of variations within the scope of the invention may exist. The foregoing examples are not intended to limit the nature or the scope of the invention in any way. Rather, the foregoing detailed description provides those skilled in the art with a foundation for implementing other exemplary embodiments of the invention.

We claim:

1. A reusable divider system adapted to be selectively, removably mounted on a shelf provided with a plurality of receiving spaces each of which possesses a substantially identical profile, the divider system comprising:

an elongate strip possessing a pair of opposing side surfaces, a front end surface and an opposing rear end surface, and an upper surface and an opposing lower surface, said strip possessing a pair of front lugs depending from the lower surface thereof, said front lugs possessing a spacing therebetween and each possessing a profile configured such that each of said front lugs is adapted to be snugly received in a pair of the receiving spaces, wherein said strip possesses at least one score line extending substantially from the lower surface to the upper surface at a position substantially remote from the front surface and defining a region of relatively weak strength of said strip along which said strip is adapted to be broken whereby the effective length of said strip may be shortened and wherein the portion of said strip extending backwardly from the at least one score line possesses a tapered thickness, whereby when said strip is broken along the at least one score line, the detached portion of said strip including the tapered thickness may be used as a wedge for insertion between the lower surface of said strip and the shelving in the region adjacent to said front lugs to assist in prying said strip upwardly and away from the shelving each of said front lugs possessing a cross-sectional profile selected from the group consisting of a spline and a square having substantially chamfered corners.

2. The reusable divider system according to claim 1 wherein said strip possesses a series of score lines spaced substantially equi-distantly apart from each other.

3. The reusable divider system according to claim 1 wherein said strip further possesses a fork-shaped tab extending from the rear surface thereof, said tab possessing a channel therein, the width of which is slightly wider than the lateral width of said strip in a region remote from the front surface, said tab possessing a rear lug having a profile configured such that said rear lug is adapted to be snugly received in one of the receiving spaces, said rear lug possessing a profile substantially identical to the profile of each of said front lugs, said tab attached to the other portions of said strip by a region of relatively weak strength by which said tab is adapted to be detached from the other portions of said strip, whereby said rear lug may be inserted into a receiving space such that said detached tab may be maintained in an upstanding position relative to the shelf with the channel therein adapted to receive a remaining portion of said strip therein.

4. The reusable divider system according to claim 1 wherein the lower surface of said strip possesses a recessed region between said front lugs which is adapted to receive a device for prying said strip upwardly and away from the shelving.

5. A reusable, extensible divider system adapted to be selectively, removably mounted on a shelf provided with a plurality of receiving spaces each of which possesses a substantially identical profile, the divider system comprising:

a first elongate strip and a second elongate strip each possessing a pair of opposing lateral side surfaces, and an upper region and a lower region, said first strip substantially overlapping said second strip such that a lateral side surface of said first strip faces a lateral side surface of said second strip, at least one of said upper region and said lower region of said second strip provided with means for retaining said first strip in a substantially overlapping relationship with said second strip while permitting said first strip to translate reciprocally with respect to said second strip, wherein said retaining means comprises a series of upper fingers spaced along the upper region of said second strip and a series of lower fingers spaced along the lower region of said second strip, each of said upper fingers extending over the upper region of said first strip and each of said lower fingers extending over the lower region of said first strip, wherein the upper region of said first strip possesses an upper beveled, linearly extending edge, and wherein the lower region of said first strip possesses a lower beveled, linearly extending edge, said upper edge substantially parallel to said lower edge, and wherein each of said upper fingers possesses a beveled surface adapted to intimately face against the upper beveled edge of said first strip and each of said lower fingers possesses a beveled surface adapted to intimately face against the lower beveled surface of said first strip, each of said strips possessing at least one lug depending from the lower region thereof, each of said lugs possessing a profile configured such that each of said lugs is adapted to be snugly received in an associated one of the receiving spaces.

6. The reusable, extensible divider system according to claim 5 wherein the profile of each of the receiving spaces may be either substantially square or substantially circular.

7. The reusable, extensible divider system according to claim 5 wherein the distal end of each of said lugs possesses a bulbous configuration.

8. The reusable, extensible divider system according to claim 5 wherein each of said lugs possesses a cross-sectional profile selected from the group consisting of a spline in which the peripherally distal edge ends are chamfered with a rounded contour and a square in which the corners are chamfered with a rounded contour.

9. The reusable, extensible divider system according to claim 8 wherein the splined cross-sectional profile is in the shape of a cross comprising two orthogonal arms, each arm having a length in the range of about 0.23 to 0.25 inches.

10. The reusable, extensible divider system according to claim 5 wherein said upper beveled edge, said lower beveled edge, said beveled surface of each of said upper fingers, and said beveled surface of each of said lower fingers, form a dove-tail slide.

11. The reusable, extensible divider system according to claim 5 wherein each of said strips possesses a seating plate disposed above an associated lug depending from the lower region of said strip, said seating plate possessing a flat lower surface adapted to abut against a surface of the shelf when said associated lug is snugly received in an associated one of the receiving spaces.

12. A reusable, extensible divider system according to claim 5 wherein each of said opposing lateral side surfaces of each of said strips possesses a substantially rectangular peripheral configuration.

13. A reusable, extensible divider system adapted to be selectively, removably mounted on a shelf provided with a plurality of receiving spaces each of which possesses a substantially identical profile, the divider system comprising:

a first elongate strip and a second elongate strip each possessing a pair of opposing lateral side surfaces, and an upper region and a lower region, said first strip substantially overlapping said second strip such that a lateral side surface of said first strip faces a lateral side surface of said second strip, at least one of said upper region and said lower region of said second strip provided with means for retaining said first strip in a substantially overlapping relationship with said second strip while permitting said first strip to translate reciprocally with respect to said second strip, each of said strips possessing at least one lug depending from the lower region thereof, each of said lugs possessing a profile configured such that each of said lugs is adapted to be snugly received in an associated one of the receiving spaces and possessing a cross-sectional profile consisting of a spline in which the peripherally distal edge ends are chamfered with a rounded contour.

14. The reusable, extensible divider system according to claim 13 wherein the distal end of each of said lugs possesses a bulbous configuration.

15. The reusable, extensible divider system according to claim 13 wherein the splined cross-sectional profile is in the shape of a cross comprising two orthogonal arms, each arm having a length in the range of about 0.23 to 0.25 inches.

16. The reusable, extensible divider system according to claim 13 wherein said retaining means comprises a series of upper fingers spaced along the upper region of said second strip and a series of lower fingers spaced along the lower region of said second strip, each of said upper fingers extending over the upper region of said first strip and each of said lower fingers extending over the lower region of said first strip.

17. The reusable, extensible divider system according to claim 13 wherein each of said strips possesses a seating plate disposed above an associated lug depending from the lower region of said strip, said seating plate possessing a flat lower surface adapted to abut against a surface of the shelf when said associated lug is snugly received in an associated one of the receiving spaces.

18. A reusable, extensible divider system according to claim 13 wherein each of said opposing lateral side surfaces of each of said strips possesses a substantially rectangular peripheral configuration.

19. A reusable, extensible divider system adapted to be selectively, removably mounted on a shelf provided with a plurality of receiving spaces each of which possesses a substantially identical profile, the divider system comprising:

a first elongate strip and a second elongate strip each possessing a pair of opposing lateral side surfaces, and an upper region and a lower region, said first strip substantially overlapping said second strip such that a lateral side surface of said first strip faces a lateral side surface of said second strip, at least one of said upper region and said lower region of said second strip provided with means for retaining said first strip in a substantially overlapping relationship with said second strip while permitting said first strip to translate reciprocally with respect to said second strip, each of said strips possessing at least one lug depending from the lower region thereof, each of said lugs possessing a profile configured such that each of said lugs is adapted to be snugly received in an associated one of the receiving spaces and possessing a cross-sectional profile consisting of a square in which the corners are chamfered with a rounded contour.

20. The reusable, extensible divider system according to claim 19 wherein the distal end of each of said lugs possesses a bulbous configuration.

21. The reusable, extensible divider system according to claim 19 wherein said retaining means comprises a series of upper fingers spaced along the upper region of said second strip and a series of lower fingers spaced along the lower region of said second strip, each of said upper fingers extending over the upper region of said first strip and each of said lower fingers extending over the lower region of said first strip.

22. The reusable, extensible divider system according to claim 19 wherein each of said strips possesses a seating plate disposed above an associated lug depending from the lower region of said strip, said seating plate possessing a flat lower surface adapted to abut against a surface of the shelf when said associated lug is snugly received in an associated one of the receiving spaces.

23. A reusable, extensible divider system according to claim 19 wherein each of said opposing lateral side surfaces of each of said strips possesses a substantially rectangular peripheral configuration.

24. A reusable, extensible divider system adapted to be selectively, removably mounted on a shelf provided with a plurality of receiving spaces each of which possesses a substantially identical profile, the divider system comprising:

a first elongate strip and a second elongate strip each possessing a pair of opposing lateral side surfaces, and an upper region and a lower region, said first strip substantially overlapping said second strip such that a lateral side surface of said first strip faces a lateral side surface of said second strip, at least one of said upper region and said lower region of said second strip provided with means for retaining said first strip in a substantially overlapping relationship with said second strip while permitting said first strip to translate reciprocally with respect to said second strip, each of said strips possessing a pair of lugs depending from the lower region thereof, each of said lugs possessing a splined peripheral surface and possessing a profile configured such that each of said lugs is adapted to be snugly received in an associated one of the receiving spaces, the lugs of each pair of lugs being separated from each other a distance of one to one and a half inches apart.

25. The reusable, extensible divider system according to claim 24 wherein each of said lugs possesses a substantially cross-shaped cross-sectional profile in which the peripherally distal edge ends are chamfered with a rounded contour.

26. The reusable, extensible divider system according to claim 25 wherein the cross-shaped profile comprises two orthogonal arms, each arm having a length in the range of about 0.234 to 0.238 inches.

* * * * *